US006766713B2

(12) United States Patent
Sundaresan et al.

(10) Patent No.: US 6,766,713 B2
(45) Date of Patent: Jul. 27, 2004

(54) CONTROL SYSTEM FOR ADJUSTABLE PEDAL ASSEMBLY HAVING INDIVIDUAL MOTOR DRIVES

(75) Inventors: Srini Sundaresan, Troy, MI (US); Gordon Smith, Lake Orion, MI (US); Michael David Hershey, Rochester Hills, MI (US)

(73) Assignee: Dura Global Technologies, Inc., Rochester Hills, MI (US)

( * ) Notice: Subject to any disclaimer, the term of this patent is extended or adjusted under 35 U.S.C. 154(b) by 64 days.

(21) Appl. No.: 10/234,724

(22) Filed: Sep. 3, 2002

(65) Prior Publication Data

US 2002/0194948 A1 Dec. 26, 2002

Related U.S. Application Data

(63) Continuation-in-part of application No. 10/026,499, filed on Dec. 19, 2001, which is a continuation of application No. 09/492,636, filed on Jan. 27, 2000, now Pat. No. 6,352,007.

(51) Int. Cl.[7] ..... G05G 1/14
(52) U.S. Cl. ..... 74/512
(58) Field of Search ..... 74/512–514, 560; 701/49

(56) References Cited

U.S. PATENT DOCUMENTS

| | | | | |
|---|---|---|---|---|
| 4,870,871 A | | 10/1989 | Ivan | 74/513 |
| 5,632,183 A | | 5/1997 | Rixon | 74/512 |
| 5,697,260 A | | 12/1997 | Rixon | 74/514 |
| 5,722,302 A | | 3/1998 | Rixon | 74/512 |
| 5,819,593 A | | 10/1998 | Rixon | 74/514 |
| 5,937,707 A | | 8/1999 | Rixon | 74/560 |
| 5,964,125 A | | 10/1999 | Rixon | 74/514 |
| 6,151,986 A | * | 11/2000 | Willemsen et al. | 74/512 |
| 6,178,847 B1 | * | 1/2001 | Willemsen et al. | 74/512 |
| 6,352,007 B1 | | 3/2002 | Zhang | 74/512 |
| 6,367,349 B1 | | 4/2002 | Allen | 74/512 |
| 6,450,061 B1 | * | 9/2002 | Chapman et al. | 74/512 |

OTHER PUBLICATIONS

U.S. patent application Ser. No. 848,400, filed May 3, 2001, Chapman.
U.S. patent application Ser. No. 748,666, filed Jun. 27, 2002, Flynn.

* cited by examiner

*Primary Examiner*—Chong H. Kim
(74) *Attorney, Agent, or Firm*—Richard M. Mescher; Casimir R. Kiczek

(57) ABSTRACT

A control pedal assembly includes a first control pedal including a first pedal adjustable in a fore-aft direction upon operation of a first motor and a second control pedal including a second pedal adjustable in a fore-aft direction upon operation of a second motor. The first pedal and the second pedal have a predetermined fore-aft relationship. A controller is operably connected to the first motor and the second motor. The controller is programmed to operate the first and second motors to simultaneously move the first and second pedals in the fore-aft direction and to reestablish the predetermined relationship if the predetermined fore-aft relationship is not maintained as a result of the movement of the first and second control pedals.

20 Claims, 14 Drawing Sheets

Fig. 5A
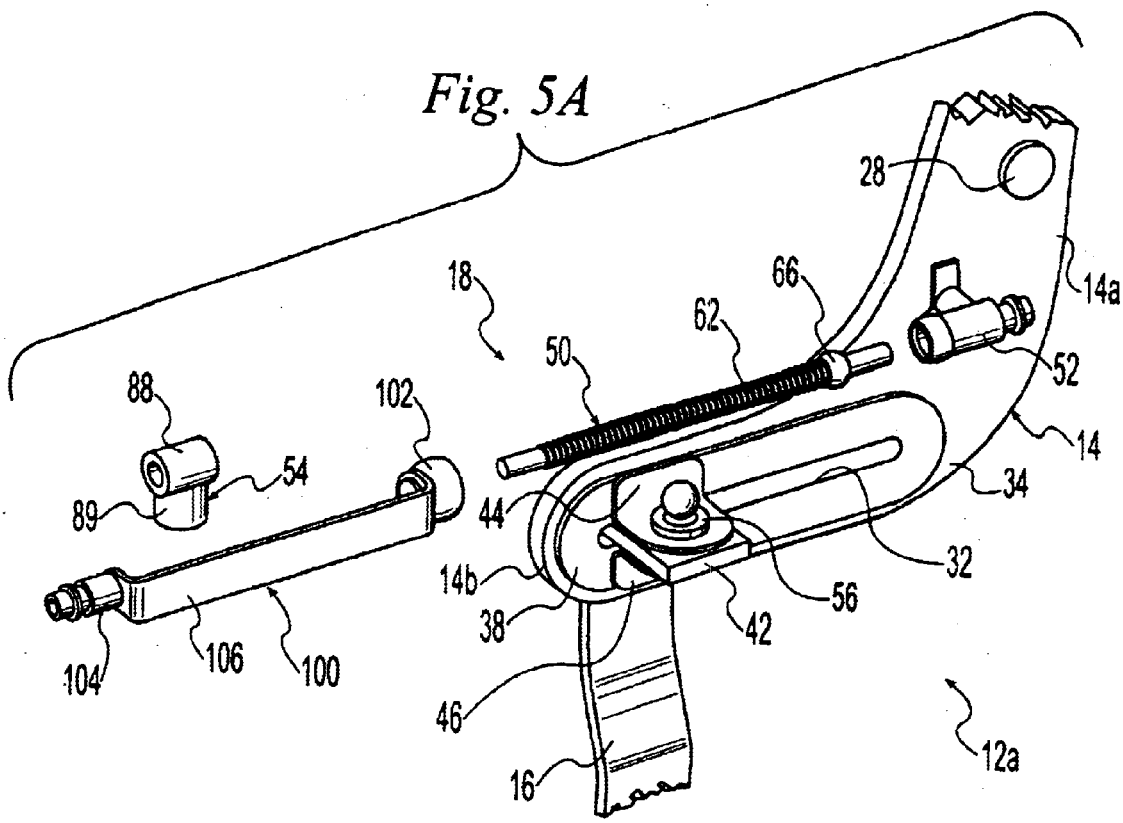
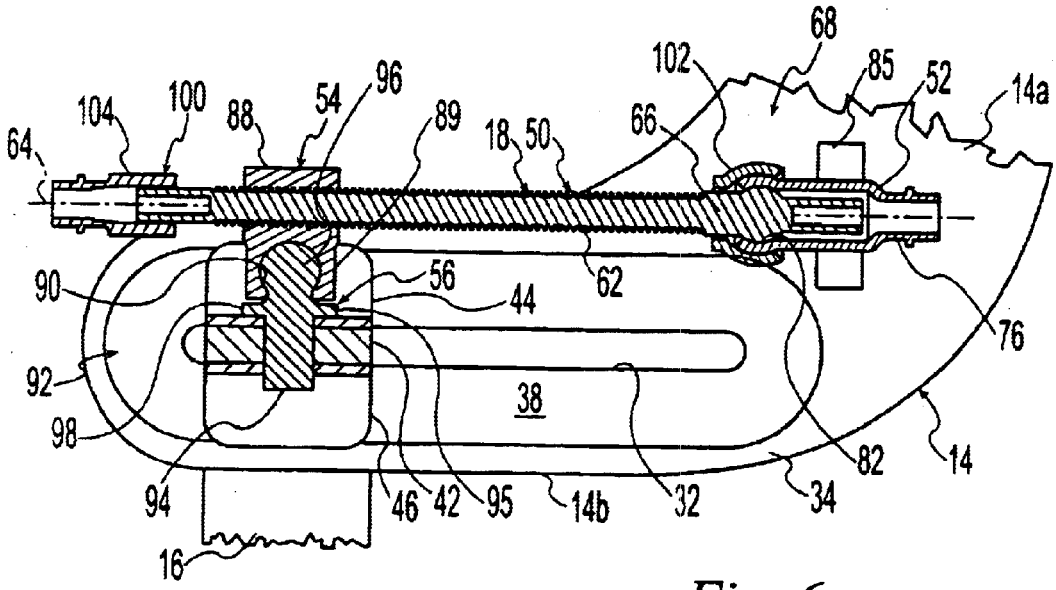
Fig. 6

| PROCESS | INPUT | | | | | | | | | | | OUTPUT | | |
|---|---|---|---|---|---|---|---|---|---|---|---|---|---|---|
| | IGNITION | PARK SWITCH | POSITION SENSOR A | POSITION SENSOR B | MOTOR A CURRENT | MOTOR B CURRENT | FORWARD BUTTON | REVERSE BUTTON | MEM 1 BUTTON | MEM 2 BUTTON | MEN 3 BUTTON | MOTOR A | MOTOR B | LED LIGHT |
| AUTO - EGRESS | X | X | X | X | | | | | | | | X | X | |
| SOFT STOPS | | | X | X | | | | | | | | X | X | |
| STEP - OVER PROTECTION | | | X | X | | | | | | | | X | X | X |
| ANTI - THEFT | X | X | X | X | X | X | | | | | | X | X | |
| MOTOR SPEED CONTROL | | | X | X | | | | | | | | X | X | |
| OBSTACLE DETECTION | | | X | X | X | X | | | | | | X | X | X |
| FAULT DETECTION | | | X | X | X | X | | | | | | X | X | X |
| MANUAL PEDALS FORWARD | X | X | | | | | X | | | | | X | X | |
| MANUAL PEDALS REVERSE | X | X | | | | | | X | | | | X | X | |
| MEMORY POSITION SET | X | | X | X | | | | | X | X | X | | | X |
| MEMORY POSITION RECALL | X | X | X | X | | | | | X | X | X | X | X | |

*Fig. 15*

CONTROL SYSTEM FOR ADJUSTABLE PEDAL ASSEMBLY HAVING INDIVIDUAL MOTOR DRIVES

CROSS-REFERENCE TO RELATED APPLICATIONS

This application is a continuation-in-part of patent application Ser. No. 10/026,499 filed on Dec. 19, 2001 which is a continuation of patent application Ser. No. 09/492,636 filed on Jan. 27, 2000, now U.S. Pat. No. 6,352,007.

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to control pedals for a motor vehicle and, more particularly, to control pedals which can be selectively adjusted to desired positions.

BACKGROUND OF THE INVENTION

Control pedals are typically provided in a motor vehicle, such as an automobile, which are foot operated by the driver. Separate control pedals are provided for operating brakes and an engine throttle. When the motor vehicle has a manual transmission, a third control pedal is provided for operating a transmission clutch. A front seat of the motor vehicle is typically mounted on tracks so that the seat is forwardly and rearwardly adjustable along the tracks to a plurality of positions so that the driver can adjust the front seat to the most advantageous position for working the control pedals.

This adjustment method of moving the front seat along the tracks generally fills the need to accommodate drivers of various size, but it raises several concerns. First, this adjustment method still may not accommodate all drivers due to very wide differences in anatomical dimensions of drivers. Second, the position of the seat may be uncomfortable for some drivers. Therefore, it is desirable to have an additional or alternate adjustment method to accommodate drivers of various size.

Many proposals have been made to selectively adjust the position of the control pedals relative to the steering wheel and the front seat in order to accommodate drivers of various size. For example, U.S. Pat. Nos. 5,632,183, 5,697,260, 5,722,302, 5,819,593, 5,937,707, and 5,964,125, the disclosures of which are expressly incorporated herein in their entirety by reference, each disclose an adjustable control pedal assembly. The control pedal assembly includes a hollow guide tube, a rotatable screw shaft co-axially extending within the guide tube, a nut in threaded engagement with the screw shaft and slidable within the guide tube, and a control pedal rigidly connected to the nut. The control pedal is moved forward and rearward when an electric motor rotates the screw shaft to translate the nut along the screw shaft within the guide tube. A potentiometer is provided at the motor which sends signals to a CPU regarding motor shaft position for determining the position of the nut. A flexible shaft connects the screw shafts of the accelerator and brake pedals so that a single motor operates both pedals. While this control pedal assembly may adequately adjust the position of the control pedal to accommodate drivers of various size, this control pedal may be prone to undetected failures, unreliable, noisy, and expensive to produce. Accordingly, there is a need in the art for an adjustable control pedal assembly which selectively adjusts the position of the pedal to accommodate drivers of various size, is relatively simple and inexpensive to produce, and/or is highly reliable with relatively low noise in operation.

SUMMARY OF THE INVENTION

The present invention provides an adjustable control pedal assembly and a method of operating an adjustable control pedal assembly which overcomes at least some of the above-noted problems of the related art. According to the present invention, a control pedal assembly includes, in combination, a first control pedal including a first pedal adjustable in a fore-aft direction upon operation of a first motor and a second control pedal including a second pedal adjustable in a fore-aft direction upon operation of a second motor. The first pedal and the second pedal have a predetermined fore-aft relationship. A controller is operably connected to the first motor and the second motor. The controller is programmed to operate the first and second motors to simultaneously move the first and second pedals in the fore-aft direction and to reestablish the predetermined relationship if the predetermined fore-aft relationship is not maintained as a result of the movement of the first and second control pedals.

According to another aspect of the present invention, a method of operating a control pedal assembly comprising the steps of, in combination, providing a first adjustable control pedal including a first pedal adjustable in a fore-aft direction upon operation of a first motor and providing a second adjustable control pedal including a second pedal adjustable in a fore-aft direction upon operation of a second motor. A predetermined fore-aft relationship is provided between the first pedal and the second pedal. The first and second pedals are simultaneously moved in the fore aft direction. The predetermined fore-aft relationship is reestablished if the predetermined fore-aft relationship is not maintained as a result of the step of simultaneously moving the first and second control pedals in the fore-aft direction.

From the foregoing disclosure and the following more detailed description of various preferred embodiments it will be apparent to those skilled in the art that the present invention provides a significant advance in the technology and art of control pedal assemblies. Particularly significant in this regard is the potential the invention affords for providing a high quality, feature-rich, low cost assembly. Additional features and advantages of various preferred embodiments will be better understood in view of the detailed description provided below.

BRIEF DESCRIPTION OF THE DRAWINGS

These and further features of the present invention will be apparent with reference to the following description and drawing, wherein:

FIG. 5A is an enlarged, fragmented perspective view of a portion of FIG. 3 showing a drive assembly of one of the control pedals of FIGS. 1 to 4, wherein the view is partially exploded and some components are removed for clarity;

FIG. 6 is an enlarged, fragmented elevational view, in cross section, of the drive assembly of FIG. 5A;

FIG. 15 is a table showing input and output signals of a central processing unit for various processes of the adjustable control pedal assembly of FIGS. 9 to 11.

Figure 1:
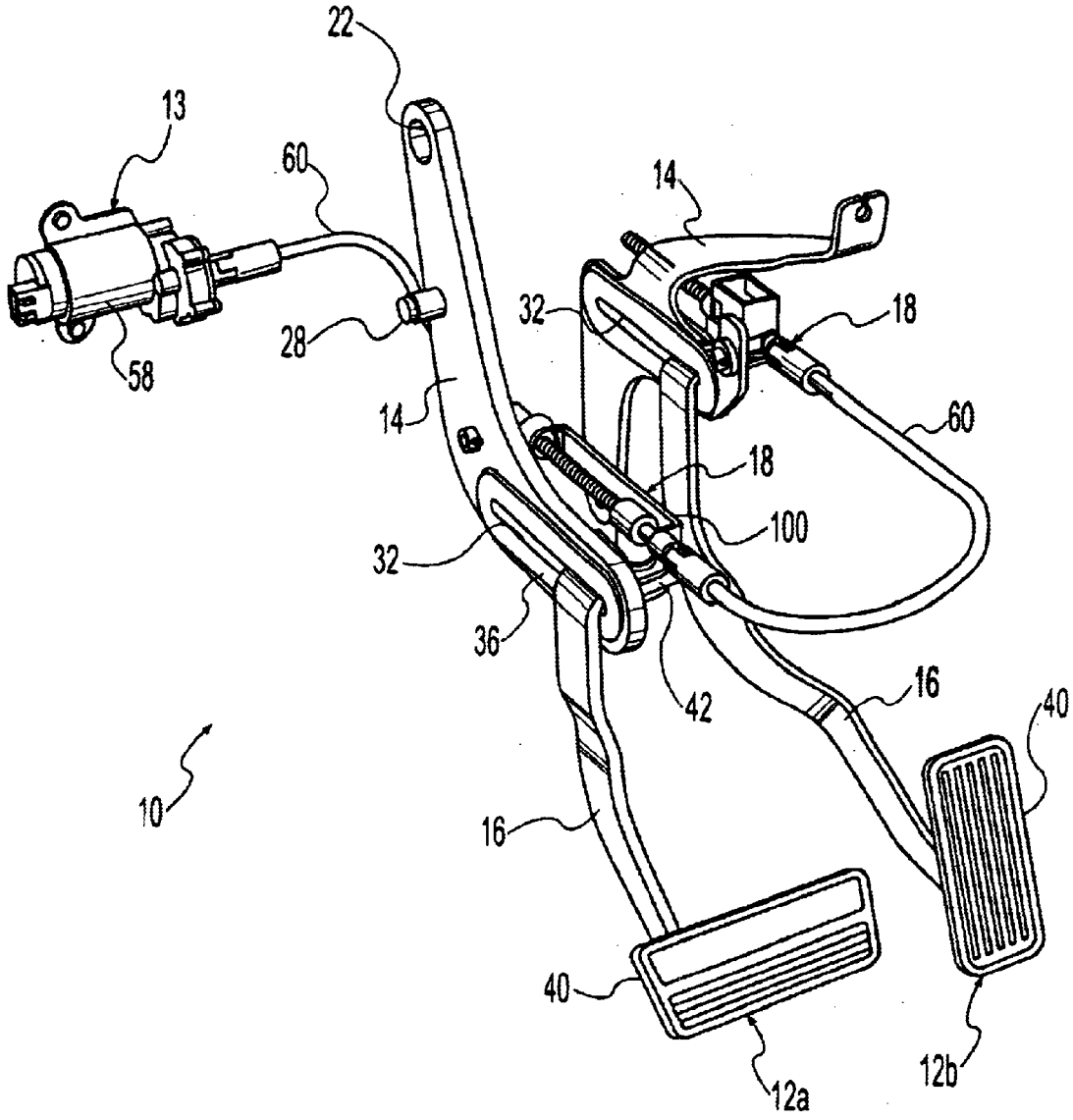
FIG. 1 is a perspective view of an adjustable control pedal assembly according to the present invention having two control pedals wherein each control pedal has a lower arm selectively movable relative to an upper arm along a horizontal slot provided in the upper arm.
Figure 2:
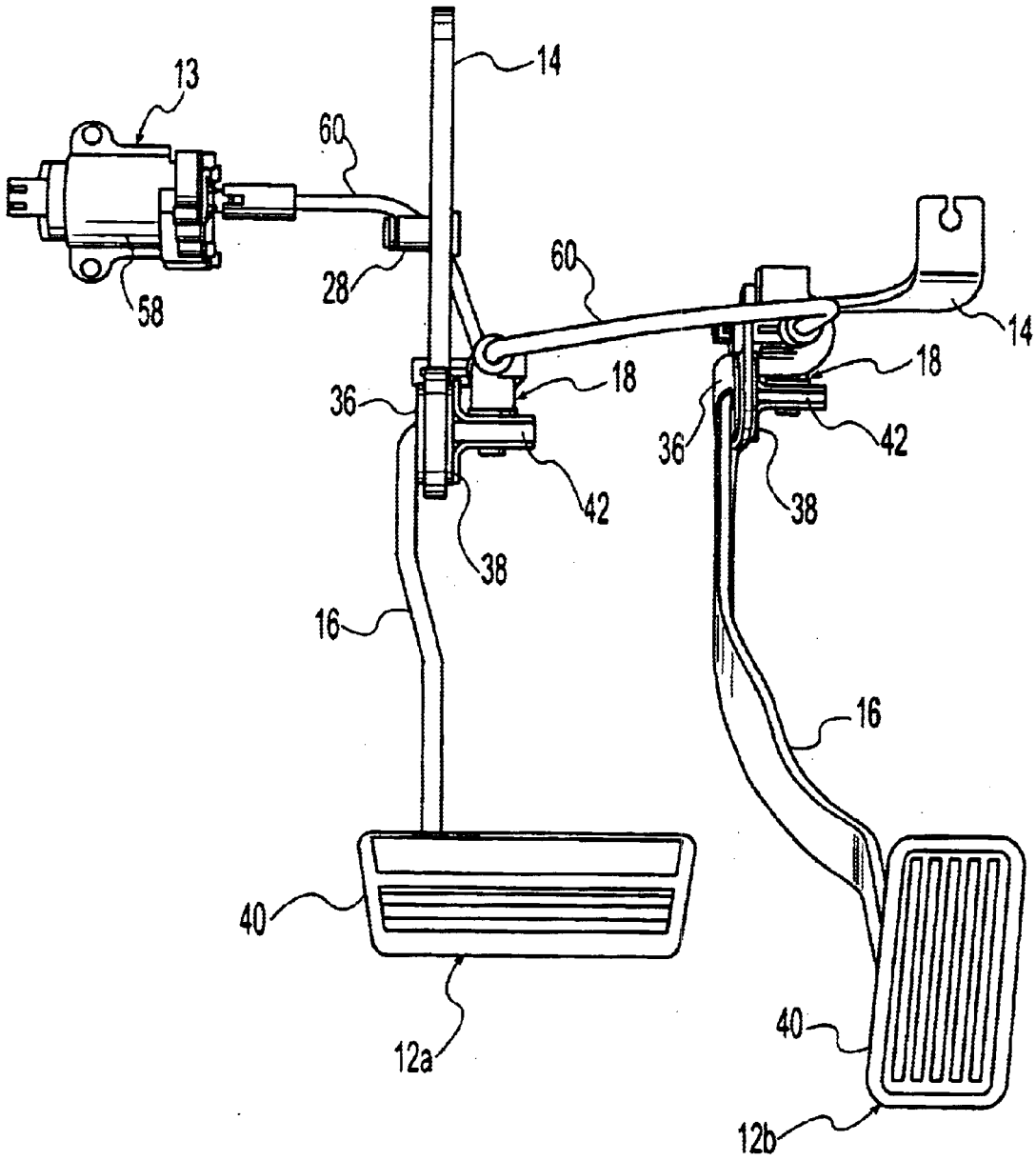
FIG. 2 is a rear elevational view of the adjustable control pedal assembly of FIG. 1.
Figure 3:
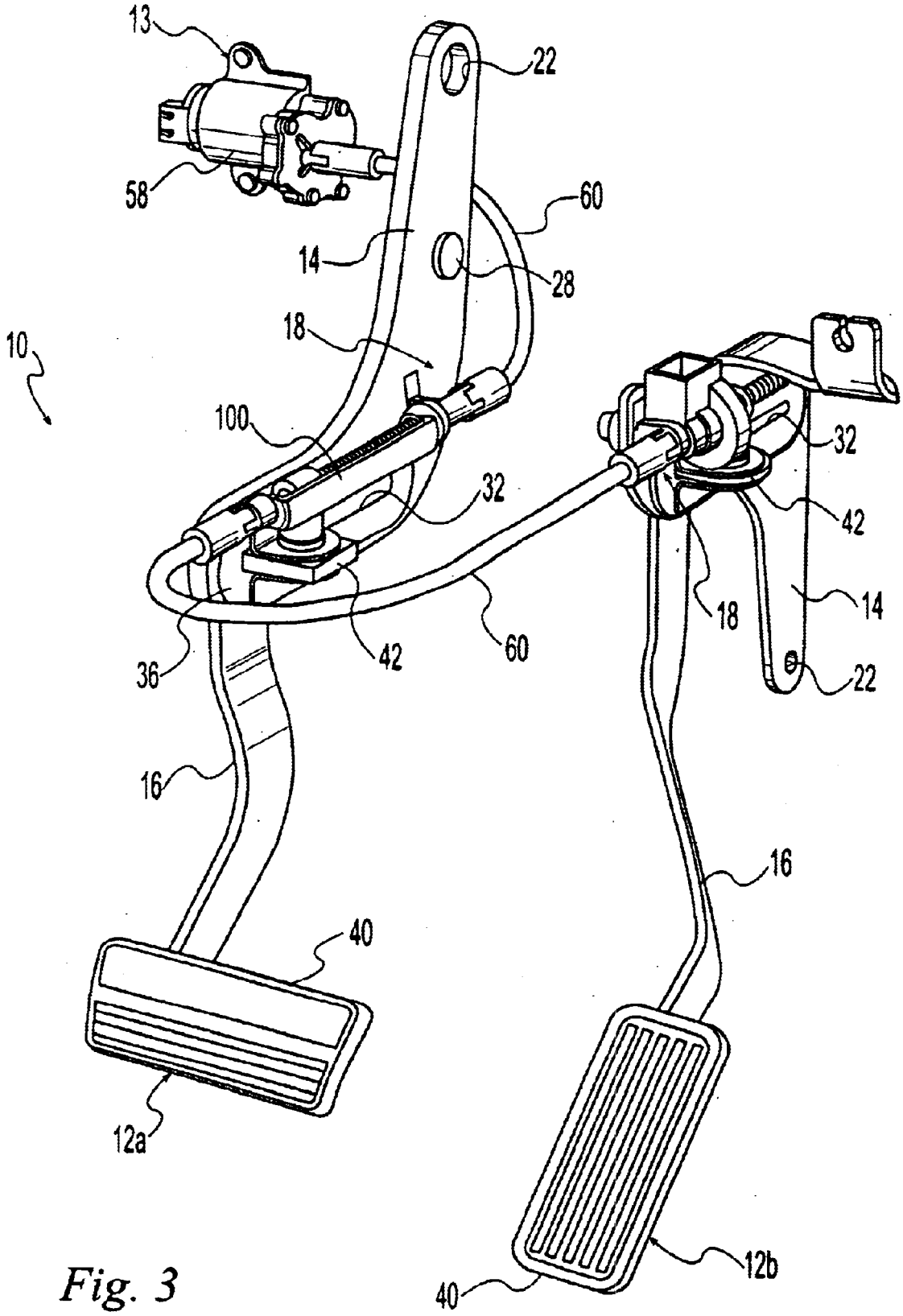
FIG. 3 is a perspective view of the adjustable control pedal assembly of FIGS. 1 and 2 showing the opposite side of FIG. 1.
Figure 4:
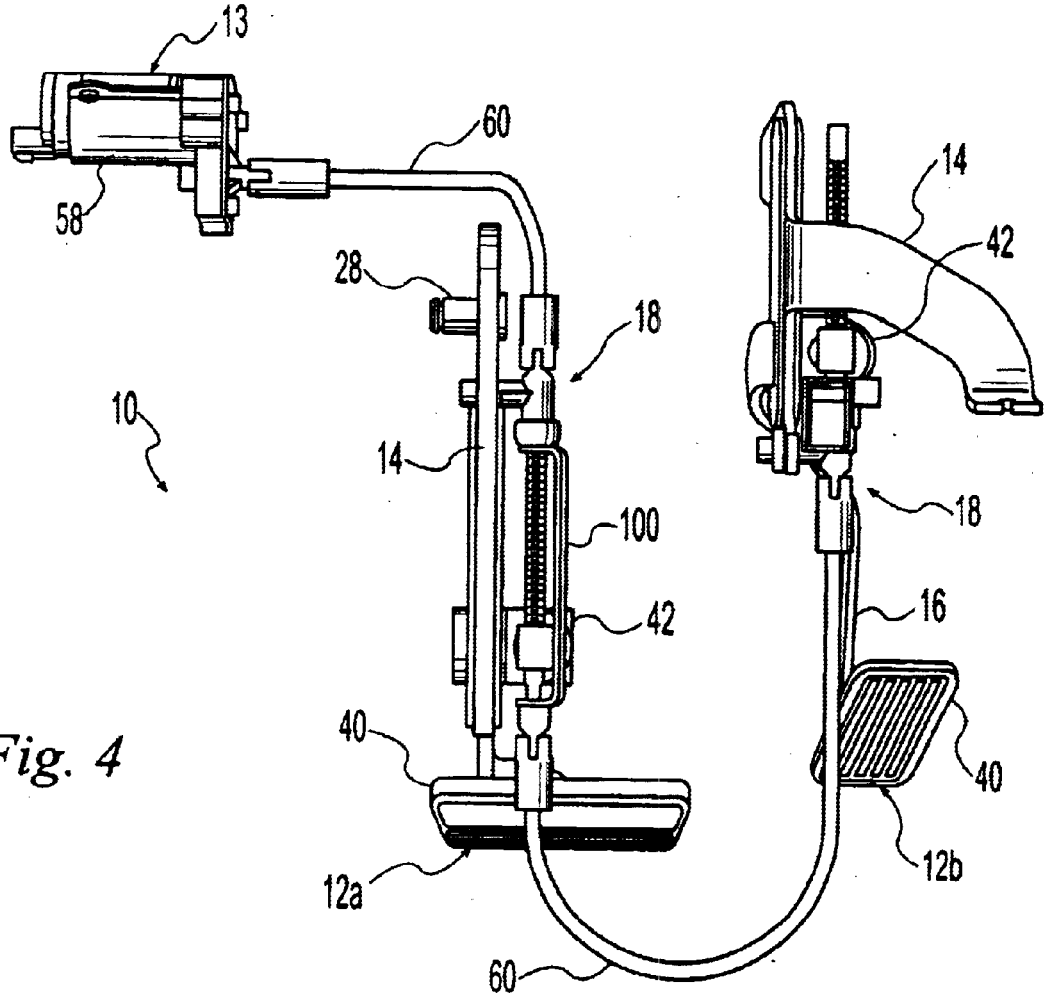
FIG. 4 is a top plan view of the adjustable control pedal assembly of FIGS. 1 to 3.

It should be understood that the appended drawings are not necessarily to scale, presenting a somewhat simplified representation of various preferred features illustrative of the basic principles of the invention. The specific design features of a control pedal assembly as disclosed herein, including, for example, specific dimensions of the upper and lower arms will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the control pedal assembly illustrated in the drawings. In general, up or upward refers to an upward direction in the plane of the paper in FIG. 1 and down or downward refers to a down direction in the plane of the paper in FIG. 1. Also in general, fore or forward refers to a direction toward the front of the motor vehicle and aft or rearward refers to a direction toward the rear of the motor vehicle.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved control pedal assemblies disclosed herein. The following detailed discussion of various alternative and preferred embodiments will illustrate the general principles of the invention with reference to a control pedal assembly for use with a motor vehicle. Other embodiments suitable for other applications will be apparent to those skilled in the art given the benefit of this disclosure. The term "snap-fit connection" is used herein and in the claims to mean a connection between at least two components wherein one of the components has an opening and the other component has a protrusion extending into the opening, and either the protrusion or the opening has a resiliently deformable to allow insertion of the protrusion into the opening as the deformable portion deforms upon entry but to deny undesired withdrawal of the protrusion from the opening after the deformable portion resiliently snaps back such that the two components are secured together.

Referring now to the drawings, FIGS. 1 to 6 show a control pedal assembly 10 for a motor vehicle, such as an automobile, according to the present invention which is selectively adjustable to a desired position by a driver. While the illustrated embodiments of the present invention are particularly adapted for use with an automobile, it is noted that the present invention can be utilized with any vehicle having at least one foot operated control pedal including trucks, buses, vans, recreational vehicles, earth moving equipment and the like, off road vehicles such as dune buggies and the like, air borne vehicles, and water borne vehicles.

The control pedal assembly 10 includes first and second control pedals 12*a*, 12*b* and a control system 13 for selectively adjusting the position of the control pedals 12*a*, 12*b*. In the illustrated embodiment, the control pedals 12*a*, 12*b* are adapted as brake and accelerator pedals respectively. While the illustrated control pedal assembly includes two control pedals 12*a*, 12*b*, it is noted that the control pedal assembly can have a single control pedal within the scope of the present invention such as, for example, a single pedal adapted as a clutch, brake or accelerator pedal. It is also noted that the control pedal assembly can have more than two control pedals within the scope of the present invention such as, for example, three pedals adapted as clutch, brake and accelerator pedals respectively.

The control pedals 12*a*, 12*b* are selectively adjustable by the operator in a forward/rearward direction. In multiple pedal embodiments, the control pedals 12*a*, 12*b* are preferably adjusted together simultaneously to maintain desired relationships between the pedals such as, for example, "step over", that is, the forward position of the accelerator pedal 12*b* relative to the brake pedal 12*a* (best shown in FIG. 4). It is noted however, that individual adjustment of each control pedal 12*a*, 12*b* is within the scope of the present invention.

Each pedal assembly is generally the same except as shown in FIGS. 1 to 6 and as noted herein below. Accordingly, only one control pedal 12*a* will be described in detail. The control pedal 12*a* includes a support or upper arm 14, a support or lower arm 16, and a drive assembly 18. The upper arm 14 is sized and shaped for pivotal attachment to a stationary support or mounting bracket. The mounting bracket is adapted to rigidly attach the adjustable control pedal assembly 10 to a firewall or other rigid structure of the motor vehicle in a known manner. The upper arm 14 is generally an elongate plate oriented in a vertical plane. The illustrated upper arm 14 is generally "L-shaped" having an upper or vertical portion 14*a* which generally vertically extends downward from the mounting bracket and a lower or horizontal portion 14*b* which generally horizontally extends in a rearward direction from a lower end of the upper portion 14*a*.

The upper portion 14*a* of the upper arm 14 is adapted for pivotal attachment to the mounting bracket. The illustrated upper arm 14 has an opening 22 formed for cooperation with the mounting bracket and a pivot pin. With the pivot pin extending through the mounting bracket and the opening 22 of and the upper arm 14, the upper arm 14 is pivotable about a horizontally and laterally extending pivot axis 26 formed by the axis of the pivot pin. The upper arm 14 is operably connected to a control device such as a clutch, brake or throttle such that pivotal movement of the upper arm 14 operates the control device in a desired manner. The upper arm 14 can be connected to the control device by, for example, a push-pull cable for mechanical actuation or electrical wire or cable for electronic signals. The illustrated upper arm 14 is provided with a pin 28 for connection to the control device of a mechanical actuator.

The lower portion 14*b* of the upper arm 14 is adapted for supporting the lower arm 16 and for selected fore and aft movement of the lower arm 16 along the lower portion 14*b* of the upper arm 14. A horizontally extending slot 32 is formed in the lower portion 14*b* of the upper arm 14 and extends the entire thickness of the plate. The lower portion 14*b* is substantially planar or flat in the area of the slot. The slot 32 is adapted for cooperation with the lower arm 16 as described in more detail hereinbelow. The illustrated upper arm 14 includes an insert 34 forming the slot 32 but it is noted that the slot 32 can be formed solely by the plate of the upper arm 14. The insert 34 is formed of any suitable low friction and/or high wear resistant material such as, for example, an acetyl resin such as DELRIN. The insert 34 preferably extends along each side of the upper arm 14 around the entire periphery of the slot 32 to form planar laterally facing bearing surfaces 36, 38 adjacent the slot 32.

The lower arm 16 is sized and shaped for attachment to the upper arm 14 and selected fore and aft movement along the slot 32 of the upper arm 14. The lower arm 16 is generally an elongate plate oriented in a vertical plane so that it is generally a downward extension of the upper arm 14. The lower arm 16 includes a pedal 40 at its lower end and a guide 42 at its upper end. The pedal 40 is adapted for depression by the driver of the motor vehicle to pivot the lower and upper arms 14, 16 about the pivot axis 26 to obtain a desired control input to the motor vehicle. The guide 42 is sized and shaped for cooperation with the slot 32 of the upper arm 14. The illustrated guide 42 is a laterally and horizontally extending tab formed by bending the upper end of the lower arm 16 substantially perpendicular to the main body of the lower arm 16. The guide 42 and the slot 32 are preferably sized to minimize vertical movement of the guide 42 within the slot 32. It is noted that the guide 42 can take many alternative forms within the scope of the present invention. It is also noted that while the illustrated guide 42 is unitary with the main body of the lower arm 16, that is of one piece construction, the guide 42 can alternatively be integrally connected to the main body of the lower arm 16, that is a separate component rigidly secured to the main body of the lower arm 16.

The guide 42 extends through the slot 32 of the upper arm 14 so that the lower arm 16 is supported by the upper arm 14 by contact of the guide 42 and a bottom bearing surface of the slot 32 and the lower arm 16 is movable fore and aft relative to the upper arm 14 as the guide 42 slides along the bottom bearing surface of the slot 32. The main body of the lower arm 16 engages the bearing surface 36 adjacent the slot 32 on one side of the upper arm 14. Upper and lower bearing members 44, 46 are secured to the free end of the guide 42 on the opposite side of the upper arm 14 and engage the bearing surface 38 adjacent the slot 32 on the other side of the upper arm 14 above and below the slot 32 respectively. The upper and lower bearing members 44, 46 have a first portion for attachment to the guide 42 and a second portion forming a planar bearing surface 48 for engagement with the bearing surface 38 of the upper arm 14. The illustrated upper and lower bearing members 44, 46 are bent plates wherein the first portion is bent substantially perpendicular to the second portion. The lower arm 16 and the upper and lower bearing members 44, 46 are preferably sized to minimize lateral movement, or "side slash", of the guide 42. Assembled in this manner, the guide 42 is held in the slot 32 to secure the lower arm 16 to the upper arm 14 such that the lower arm guide 42 and lower arm 16 are only movable, relative to the upper arm 14, fore and aft along the slot 32.

As best shown in FIGS. 5 and 6, the drive assembly 18 includes a screw shaft or drive screw 50, a drive screw housing or attachment 52 for securing the drive assembly 18 to the upper arm 14, a drive nut 54 adapted for movement along the drive screw 50 in response to rotation of the drive screw 50, a drive nut mounting bracket or attachment 56 for securing the drive assembly 18 to the lower arm 16, an electric motor 58 for rotating the drive screw 50 (best shown in FIGS. 1 to 4), and a drive cable 60 for connecting the motor 58 to the drive screw 50 (best shown in FIGS. 1 to 4).

The drive screw 50 is an elongate shaft having a central threaded portion 62 adapted for cooperation with the drive nut 54. The drive screw 50 is preferably formed of resin such as, for example, NYLON but can be alternately formed of a metal such as, for example, steel. The forward end of the drive screw 50 is provided with a bearing surface 66 which cooperates with the drive screw attachment 52 to form a first self-aligning joint 68, that is, to freely permit pivoting of the drive screw 50 relative to the drive screw attachment 52 and the upper arm 14 about at least axes perpendicular to the drive screw rotational axis 64. The first self-aligning joint 68 automatically corrects misalignment of the drive screw 50 and/or the drive nut 54. The illustrated first self aligning joint 68 also forms a snap-fit connection between the drive screw 50 and the drive screw attachment 52. The illustrated bearing surface 66 is generally frusto-spherically shaped and unitary with the drive screw 50. It is noted that the bearing surfaces 66, and thus the first self-aligning joint 68, can have other forms within the scope of the present invention such as, for example, the embodiment shown in FIG. 8 and described in more detail hereinbelow.

Figure 5B:
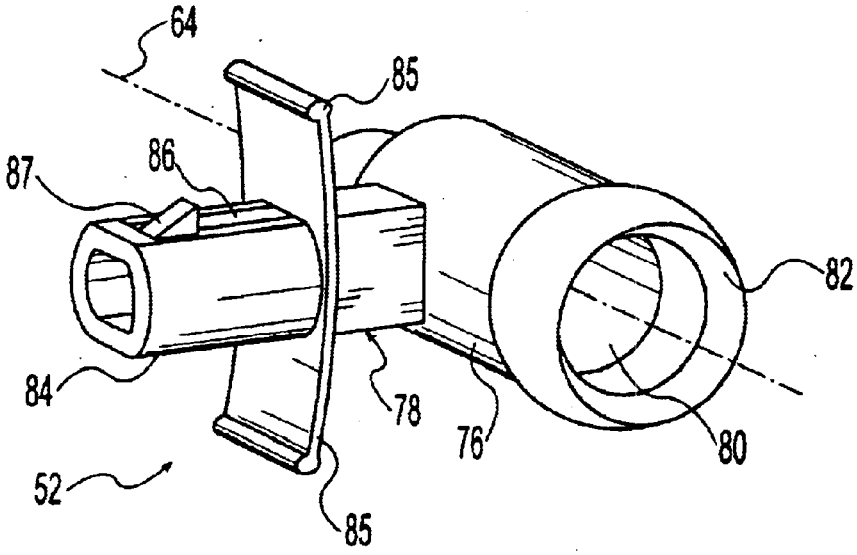
FIG. 5B is a perspective view of a drive screw attachment of the drive assembly of FIG. 5A.

As best shown in FIGS. 5B and 6, the drive screw attachment 52 is sized and shaped for supporting the drive screw 50 and attaching the drive screw 50 to the upper arm 14. The drive screw attachment 52 is preferably molded of a suitable plastic material such as, for example, NYLON but can alternatively be formed of metal such as steel. The drive screw attachment 52 includes a support portion 76 and an attachment portion 78. The support portion 76 is generally tubular-shaped having open ends. The rearward end of the support portion 76 forms a hollow portion or cavity 80 sized and shaped for cooperating the bearing surface 66 of the drive screw 50 to form the first self-aligning joint 68. The cavity 80 forms a bearing surface 82 sized and shaped to cooperate with the bearing surfaces 66 of the drive screw 50. The illustrated bearing surface 82 is a curved groove or race facing the rotational axis 64. The forward end of the support portion 76 is adapted for connection of the drive cable 60 in a known manner.

The attachment portion 78 of the drive screw attachment 52 is adapted for securing the support portion 76 to the upper arm 14. The illustrate attachment portion 78 is adapted as a "snap-in connection" having a tubular body 84 laterally extending from the support portion 76 main body, upper and lower tabs 85 extending from the body 84, and a pair of resiliently deformable fingers 86 carrying abutments 87. The body 84 is sized and shaped to extend through an opening formed in the upper arm 14 located generally above and forward of the slot 32. The tabs 85 are sized and shaped to engage the side of the upper arm 14 to limit insertion of the body 84 into the opening of the upper arm 14. The deformable fingers 86 are sized and shaped so that the fingers 86 are inwardly deflected into the hollow interior of the body 84 as the body 84 is inserted into the opening and resiliently return or spring back upon exiting the opening on the other side of the upper arm 14. Each deformable finger 86 is preferably provided with an angled camming surface to automatically deflect the finger 86 upon insertion of the body 84 into the opening of the upper arm 14. The abutments 87 formed by the fingers 86 are each sized and shaped to prevent undesired withdrawal of the body 84 from the opening of the upper arm 14 by creating an interference against withdrawal. To withdraw the body 84, the fingers 86 are depressed to inwardly move the abutments into the hollow interior of the body 84 and remove the interference.

As best shown in FIGS. 5A and 6, the drive nut 54 is adapted for movement along the drive screw 50 in response to rotation of the drive screw 50. The drive nut 54 is preferably molded of a suitable plastic material such as, for example, NYLON but can alternatively be formed of metal such as, for example steel. The illustrated drive nut 54 is generally "T-shaped" having a horizontally extending and tubular shaped top portion 88 and a vertically extending and tubular shaped bottom portion 89 downwardly extending from the center of the top portion 88. The top portion 88 has an opening extending therethrough which is provided with threads for cooperation with the drive screw 50. The threads can be unitary with the drive nut 54 or formed by an insert secured therein. The bottom portion 89 has a downward facing cavity forming a bearing surface 90 which is sized and shaped for cooperating with the drive nut attachment 56 to form a second self-aligning joint 92, that is, to freely permit pivoting of the drive nut 54 relative to the drive nut attachment 56 about at least axes perpendicular to the rotational axis 64. The illustrated second self-aligning joint 92 is a ball joint which permits pivoting of the drive nut 54 about every axis. The second self-aligning joint 92 automatically corrects misalignment of the drive nut 54 and/or drive screw 50. The illustrated second self aligning joint 92 also forms a snap-fit connection between the drive nut 54 and the drive nut attachment 56. The illustrated bearing surface 90 is generally frusto-spherically shaped. It is noted that the bearing surfaces 90, and thus the second self-aligning joint 92, can have other forms within the scope of the present invention.

The drive nut attachment 56 is sized and shaped for supporting the drive nut 54 and attaching the drive nut 54 to the lower arm 16. The drive nut attachment 56 is preferably molded of a suitable plastic material such as, for example, NYLON but can alternatively be formed of metal such as, for example, steel. The drive nut attachment 56 includes a support portion 93 and an attachment portion 94. The support portion 93 forms a bearing surface 96 for cooperation with the bearing surface 90 of the drive nut 54 as described above. The illustrated bearing surface 96 is a ball joint, that is, a generally frusto-spherically-shaped and is sized and shaped for receipt in the cavity of the drive nut 54 to engage the bearing surface 90 of the drive nut 54. The attachment portion 94 is adapted for securing the support portion 93 to the guide 42 of the lower arm 16. The illustrated attachment portion 94 is a generally cylindrically shaped protrusion which downwardly extends from the support portion 93. The attachment portion 94 is sized and shaped to extend through openings in the lower arm guide 42 and the upper and lower bearing members 44, 46. A collar 98 is preferably provided to limit downward passage of the protrusion 94 through the openings. The protrusion of the attachment portion 94 can be held in position by for example, a cotter pin, spring clip, snap-in fingers or members, or any other suitable method.

As best shown in FIGS. 1 to 4, the electric motor 58 can be of any suitable type and can be secured to the firewall or other suitable location such as, for example, the mounting bracket of the control pedal 12*a*. The drive cable 60 is preferably a flexible cable and connects the motor 58 and the drive screw 50 so that rotation of the motor 58 rotates the drive screw 50. It is noted that the drive screw 50 and the motor can be alternatively connected with a rigid connection. An input end of the drive cable 60 is connected to an output shaft of the motor 58 and an output end of the drive cable 60 is connected to the end of the drive screw 50. It is noted that suitable gearing is provided between the motor 58 and the drive screw 50 as necessary depending on the requirements of the assembly 10. It is also noted that the fixed portion or sheath of the drive cable 60 is rigidly secured to the forward end of the drive screw attachment 52 and a rotating portion or cable is operatively connected to the forward end of the drive screw 50 to rotate the drive screw 50 therewith.

As best shown in FIGS. 1 to 6, the illustrated drive assembly 18 also includes a cable support 100 for connecting the drive cable 60 of the second control pedal 12*b* to the rearward end of the drive screw 50. Connecting or chaining the drive screws 50 with the electric motor 58 in series enables a single motor 58 to be utilized to adjust multiple control pedals 12*a*, 12*b*. It should be noted that additional control pedals 12*a*, 12*b* can be connected in this manner. It is also noted that if the control pedal assembly 10 has a single control pedal 12*a*, the drive screw 50 is the final control pedal 12*b* of the drive chain, or each control pedal 12*a*, 12*b* is driven by a separate motor 58, the cable support 100 is not necessary.

As best shown in FIGS. 5A and 6, the cable support 100 has a attachment portion 102, a support portion 104, and a connecting portion 106. The attachment portion 102 is generally tubular shaped and adapted to form a "snap fit connection" with the drive screw attachment 52. The illustrated attachment portion is sized and shaped to snap over the rearward end of the drive screw attachment 52 at the first self-aligning joint 68. The support portion 104 is generally tubular shaped and adapted to support the drive cable 60 at the rearward end of the drive screw 50. The connecting portion 106 is sized and shaped to connect the attachment portion 102 and the support portion 104 such that the support portion 104 is supported by the attachment portion 102 in a cantilevered manner. The illustrated connecting portion 106 extends along the drive screw 50 at the lateral side opposite the upper arm to act as a shield or cover for the drive screw 50. Configured in this manner, the drive cable 60 is supported without additional attachment to the upper arm 14.

Figure 7:
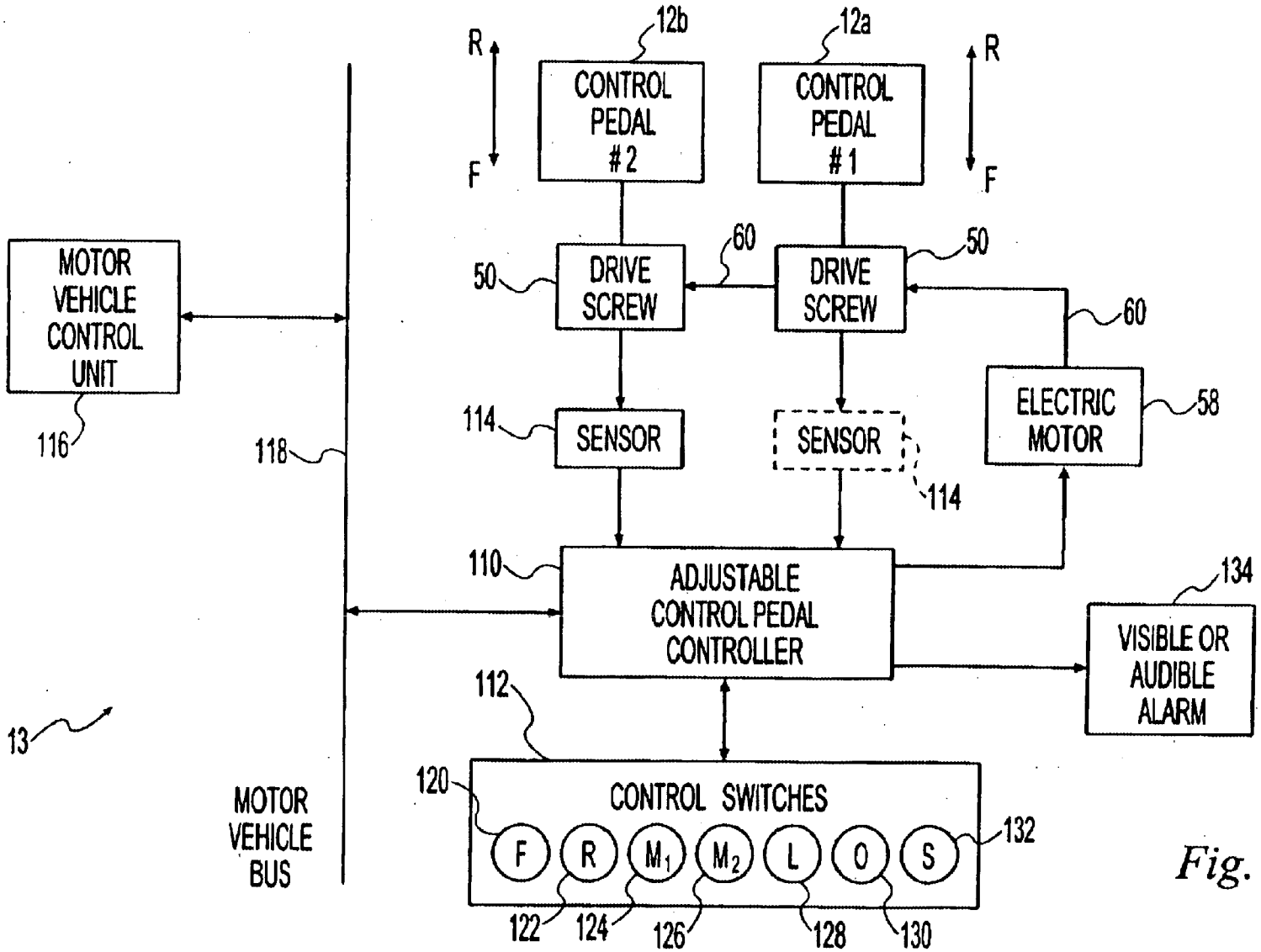
FIG. 7 is a schematic view of a control system for the adjustable control pedal assembly of FIGS. 1 to 6.

As best shown in FIG. 7, the control system 13 preferably includes a central processing unit (CPU) or controller 110 for activating the motor 58, control switches 112 for inputting information from the driver to the controller 110, and at least one sensor 114 for detecting motion of the control pedals 12*a*, 12*b* such as rotation of the drive screws 50. The control system 13 forms a control loop wherein the controller 110 selectively sends signals to the motor 58 to activate and deactivate the motor 58. When activated, the motor 58 rotates the drive screws 50 through the drive cables 60. The sensor or sensors 114 detect movement of the control pedals 12*a*, 12*b*, such as rotations of the drive screws 50, and sends signals to the controller 110.

The controller 110 includes processing means and memory means which are adapted to control operation of the adjustable control pedal assembly 10. The controller 110 is preferably in communication with a motor vehicle control unit 116 through a local bus 118 of the motor vehicle so that motor vehicle information can be supplied to or examined by the controller 110 and status of the control pedal assembly 10 can be supplied to or examined by the motor vehicle control unit 116. It is noted that while the control system 13 of the illustrated embodiment utilizes a dedicated controller 110, the controller 110 can alternatively be the motor vehicle control unit 116 or can be a controller of another system of the motor vehicle such as, for example, a keyless entry system or a powered seat system.

The control switches 112 are preferably push-button type switches but alternatively can be in many other forms such as, for example, toggle switches. The control switches 112 include at least a forward switch 120 which when activated sends control signals to move the pedal 40 in a forward direction and a reverse or rearward switch 122 which when activated sends control signals to move the pedal 40 in a rearward direction. Preferably, the control switches 112 include memory switches 124, 126 which when activated return the pedal 40 to preferred locations previously saved in memory of the controller 110, a lock out switch 128 which when activated sends control signals preventing movement of the pedal 40, an override switch 130 which when activated permits the pedal 40 to be moved by the driver in a desired manner regardless of existing conditions, and a memory save switch 132 which when activated sends a signal to save the current position of the pedal 40 in memory of the controller 110.

The sensor 114 is adapted to detect movement of the control pedal assembly 10 and send signals relating to such movement to the controller 110. The sensor 114 is preferably located adjacent the drive screw 50 and adapted to detect rotations of the drive screw 50. It is noted, however, that other sensors for detecting motion would be readily apparent to those skilled in the art such as, for example, a sensor for detecting rotational movement between upper and lower arms. The sensor 114 is preferably a Hall effect device mounted adjacent the drive screw 50 to directly sense each rotation of the drive screw 50 and to send a pulse or signal to the controller 110 for each revolution of the drive screw. Note that the pulses or signals can alternatively be for a portion of a rotation or for more than one rotation. The sensor 114 can alternately be another suitable non-contact sensor such as, for example, an inductance sensor, a potentiometer, an encoder, or the like. This rotational information obtained by sensor 114 is utilized by the controller 110 in many ways such as described hereinbelow.

The rotational information can be utilized to detect a failure in the control pedal assembly 10. A failure in the control pedal assembly 10 is detected if signals (or lack thereof) from the sensor 114 to the controller 110 indicate that the drive screw 50 is not rotating, after the controller 110 has sent signals to activate the motor 58. If the sensor 114 detects a control pedal assembly failure, the control pedal assembly 10 is preferably "shut down" to prevent any further activation of the motor 58 and possible damage to the control pedal assembly 10. By directly sensing rotation of the drive screw 50 rather than at an intermediate point such as, for example, the shaft of the motor 58, failure of any component of the control pedal assembly 10 is detected. Failures which are detected include failure of the motor 58, failure of the sensor 114, failure of the drive assembly 18, and failure of the drive cable 60. A visible warning instrument or audible alarm 134, such as the illustrated LCD, is preferably provided so that a failure condition can be indicated to the driver.

The rotational information can additionally be utilized to automatically stop the drive nut 54 at ends of travel along the drive screw 50. The controller 110 is adapted to stop the motor 58 when the rotational information indicates that the drive nut 54 has reached a predetermined end of travel along the drive screw 50. The stop points are preprogrammed in the controller 110. When the controller 110 receives signals from the sensor 114 indicating that the drive nut 54 has reached the predetermined stop points, the controller 110 stops the motor 58 and thus the movement of the drive nut 54 along the drive screw 50. For example, the total travel of the pedal assembly is defined by a predetermined number of sensor pulses and the controller 110 sends a stop signal to the motor 58 just prior to the control pedal assembly 10 reaching the saved pulse number indicating a desired end of travel so that the control pedal assembly 10 stops at the desired end of travel. Fore-aft movement of the lower arm 16, therefore, is electronically stopped without engaging mechanical stops and resulting stress on the motor 58 and mechanical components. When a "hard stop" is engaged, the motor 58 stalls and current increases which may cause overheating of the motor 58 and a resulting shortened life of the motor 58. It is noted, however, that the control pedal assembly 10 is preferably provided with mechanical or "hard" stops for limiting travel of the drive nut 54 just beyond the "soft stops" for use in the event of a failure of the electronic or "soft" stops. In the illustrated embodiment, the hard stops include the ends of the slot 32 which form abutments which are engaged by the guide 42 at the end of travel along the slot to limit fore-aft movement of the lower arm 16 and axial movement of the drive nut 54.

The rotational information can be further utilized to return the control pedal assembly 10 to a stored preferred location when selected by the driver. The driver adjusts the control pedal assembly 10 to a preferred location and engages the memory save switch 132 so that the rotational information indicating the position of the drive nut 54 in the preferred location is saved in memory. At a later time, when the driver engages a memory switch 124, 126, the controller 110 automatically starts the motor 58 to rotate the drive screw 50 and move the drive nut 54 toward the saved position of the drive nut 54. The controller 110 automatically stops the motor 58 when the rotational information (pulse count) from the sensor 114 indicates that the drive nut 54 has reached the saved position (saved pulse count) along the drive screw 50.

The controller 110 is preferably adapted so that the control pedal assembly 10 automatically moves forward to a predetermined location such as, for example, a full forward position under predetermined conditions. The predetermined conditions for moving the control pedal assembly 10 forward are preferably the ignition key off and/or the door open. The control pedal assembly 10 is then returned to the previous position or a memorized position once other predetermined conditions are met. The predetermined conditions for moving the control pedal assembly 10 back to the previous position are preferably the ignition key on and/or the door closed. By moving the control pedal assembly 10 to a forward position, the driver is able to more easily egress and/or ingress the motor vehicle.

The controller 110 is also preferably adapted so that the control pedal assembly 10 cannot be adjusted under predetermined conditions. That is, the adjustment feature of the control pedal assembly 10 is "locked-out" under certain conditions. The predetermined conditions which lock-out the control pedal assembly 10 are preferably ignition key on, motor vehicle speed exceeds a predetermined speed, door is open, trunk is open, and/or driver's seat belt not fastened. Preferably, the driver can override the lock-out by engaging the override switch 130 and/or manually engage the lock-out when desired by engaging the lock out switch 128.

Each control pedal 12*a*, 12*b* preferably includes a separate sensor 114 at the drive screw 50 so that rotation information is obtained regarding each of the drive screws 50. By having rotation information regarding each drive screw 50, the controller 110 can identify when the control pedals 12*a*, 12*b*, are not moving in the same manner. Preferably, the controller 110 sends a signal to stop the motor 58 if there is an indication that a predetermined relationship between two or more of the control pedals 12*a*, 12*b* is not maintained. For example, the predetermined relationship can be the step over of the brake and accelerator pedals. It is noted that alternatively, a single sensor 114 can be utilized which is located at the drive screw 50 at the end of the drive chain and/or separate motors 58 can be used for each of the control pedals 12*a*, 12*b*. It is also noted that while brake pedal is at the beginning of the chain and the accelerator pedal is at the end of the chain in the illustrated embodiment, the control pedals 12*a*, 12*b* can be connected in other arrangements.

Figure 8:
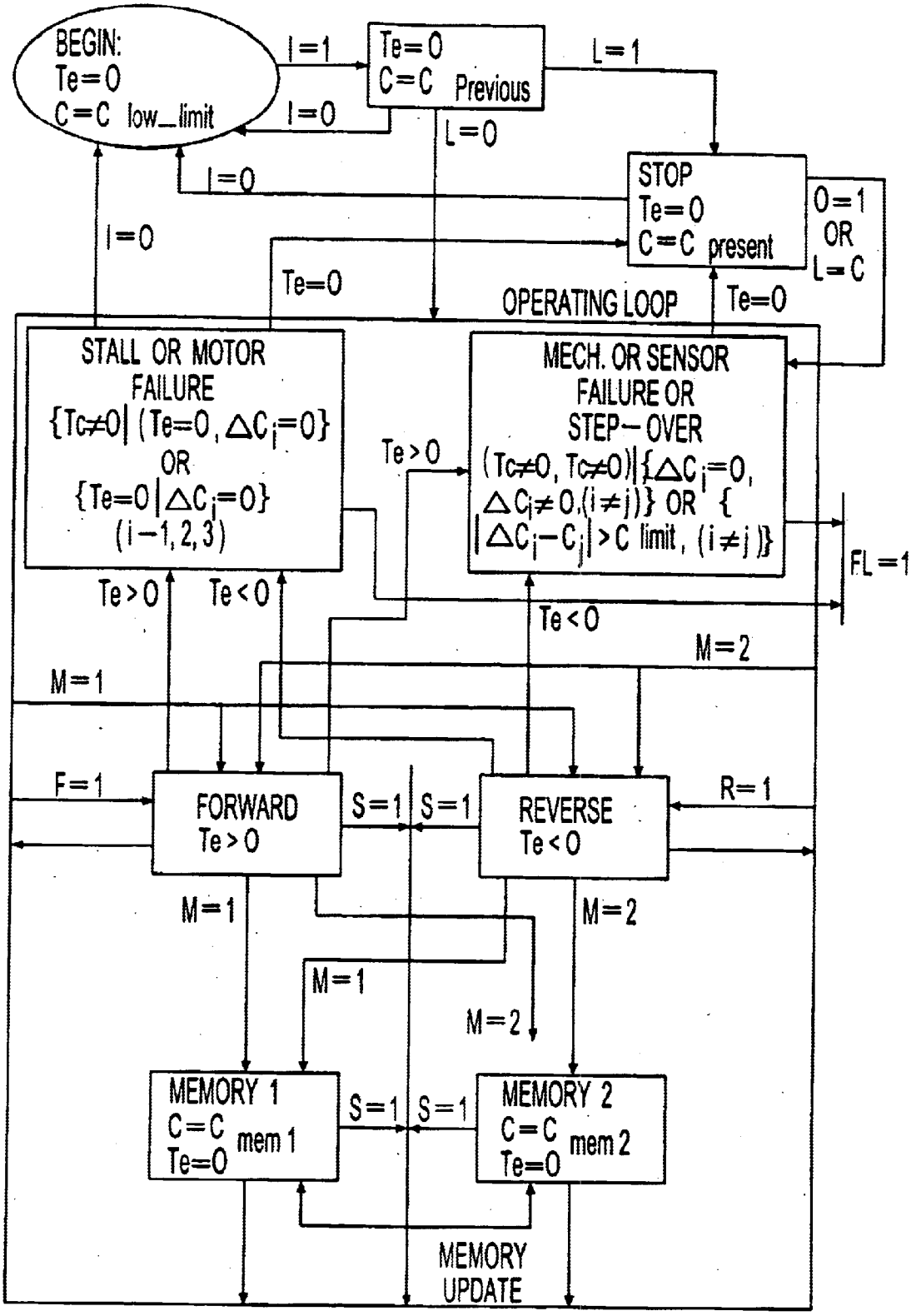
FIG. 8 is a control logic diagram for the control system of FIG. 6.
Figure 9:
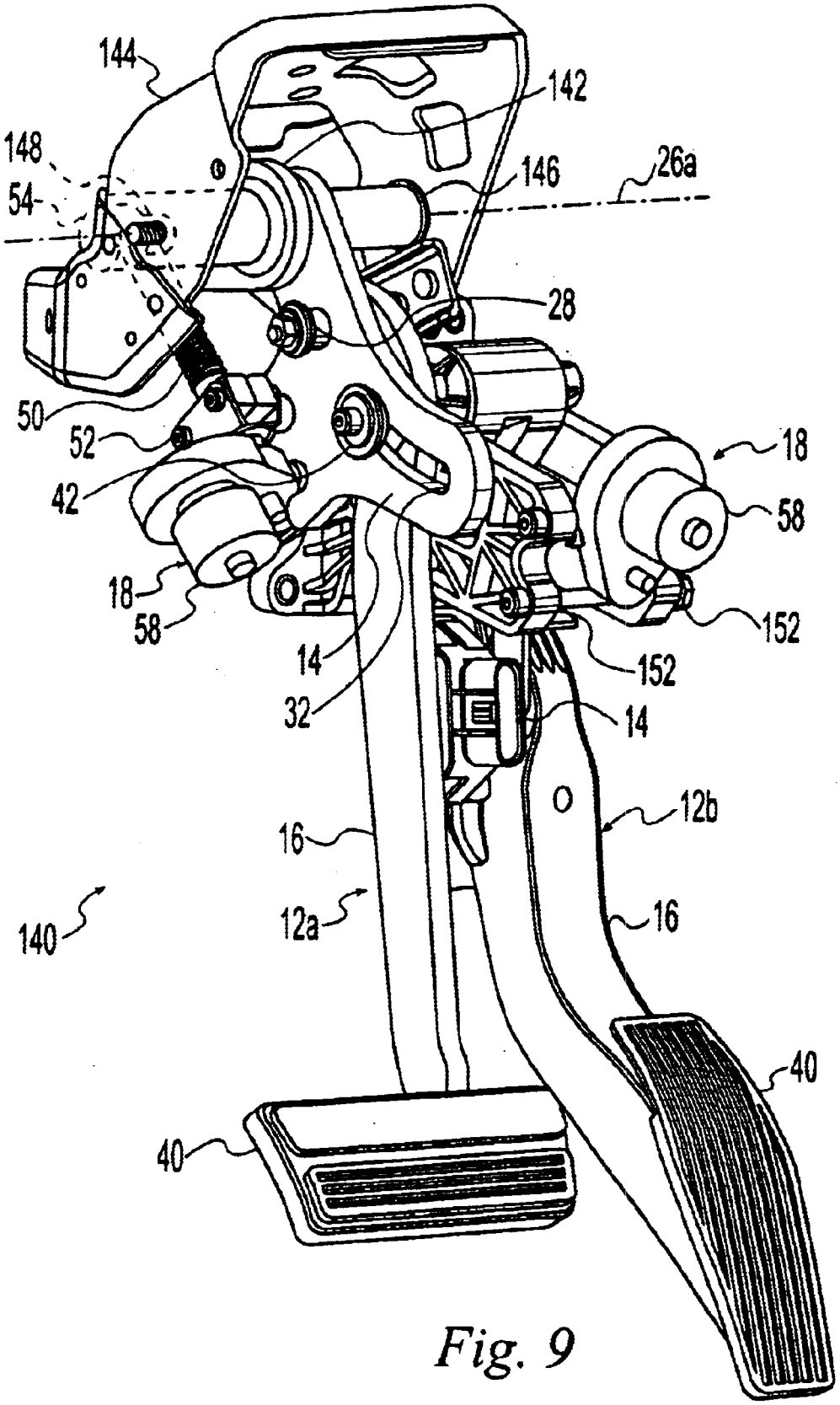
FIG. 9 is a perspective view of an adjustable control pedal assembly according to a second embodiment of the present invention.
Figure 10:
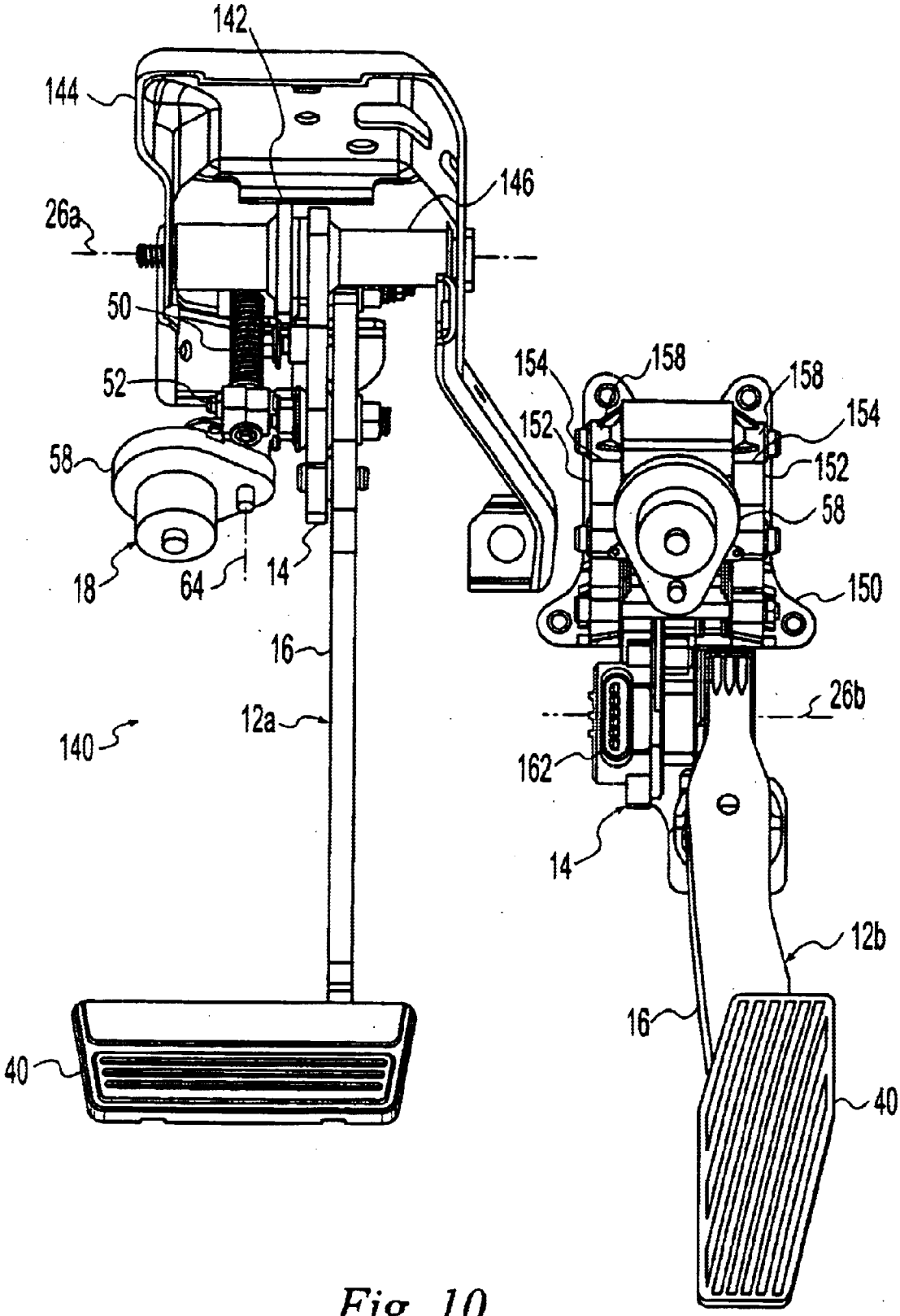
FIG. 10 is a rear elevational view of the adjustable control pedal assembly of FIG. 9.
Figure 11:
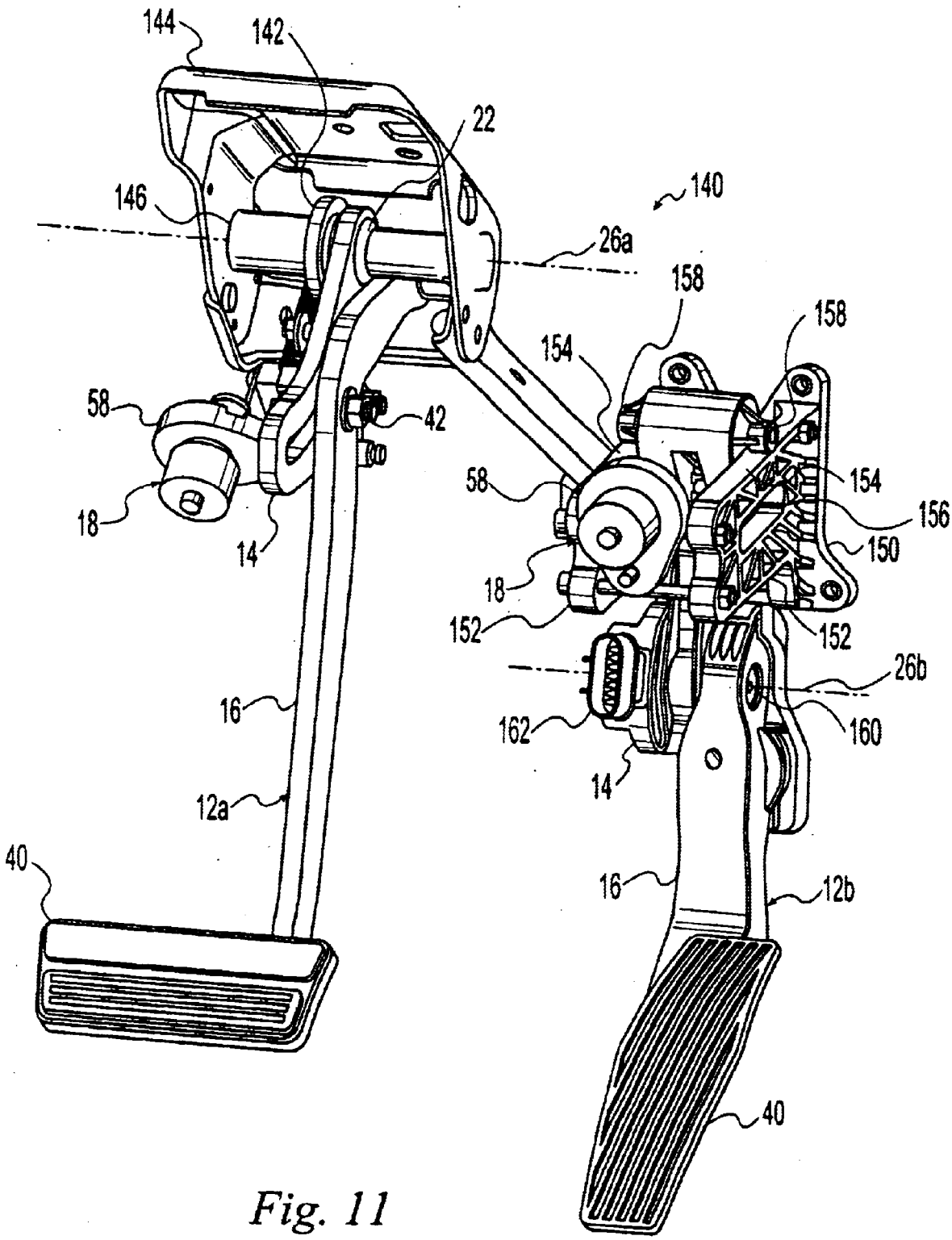
FIG. 11 is a perspective view of the adjustable control pedal assembly of FIGS. 9 and 10 showing the opposite side of FIG. 9.
Figure 12:
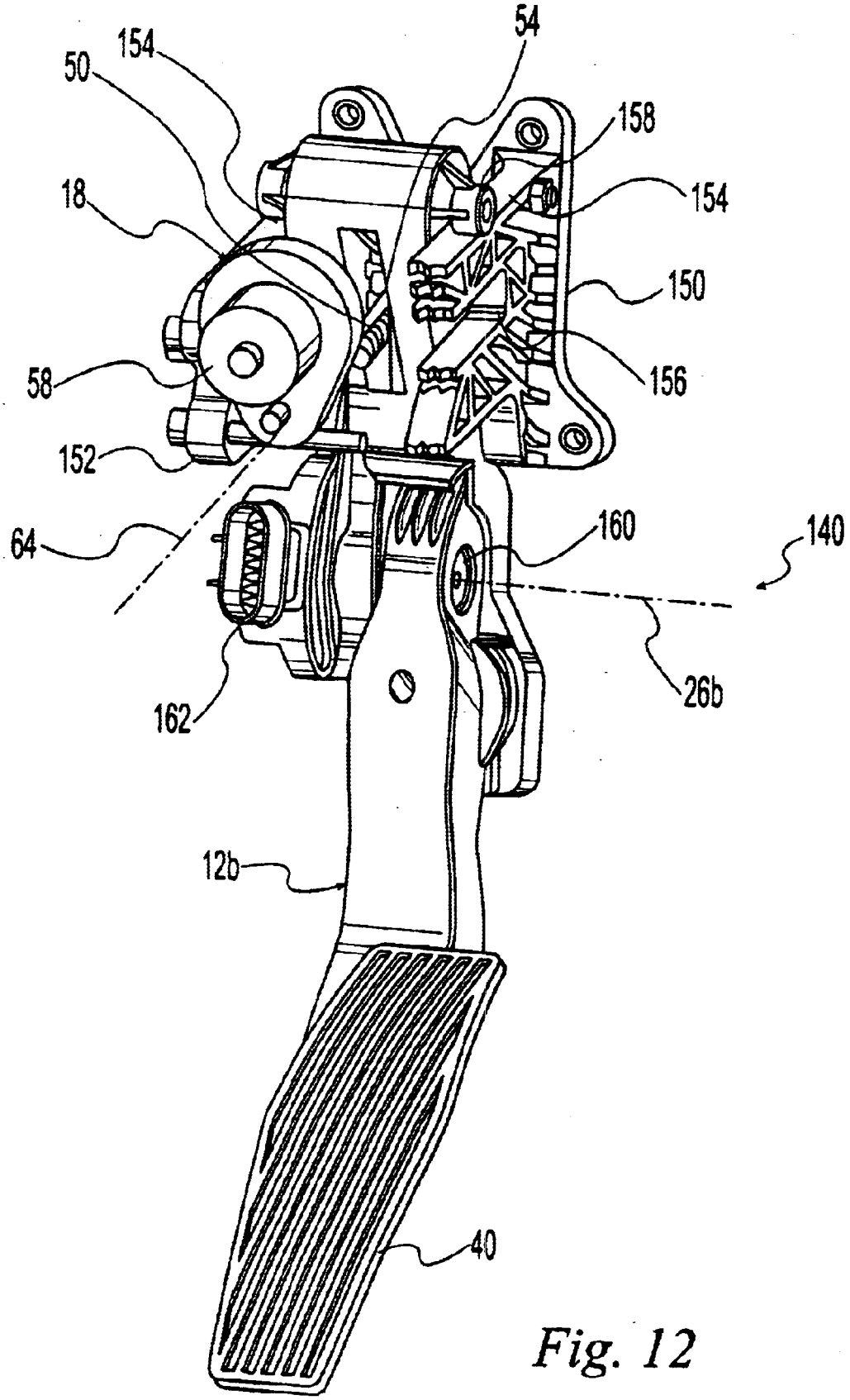
FIG. 12 is a perspective view of an accelerator pedal of the control pedal assembly of FIGS. 9 to 11 with portions broken away for clarity.

FIG. 8 illustrates a control logic diagram of a preferred control system 13 using finite-state-machine theory. The states of the control pedal assembly 10 are stop, stall or motor failure, step over, sensor or drive mechanism failure, forward, reverse (rearward), memory 1, and memory 2. Each state can be defined in terms of the sensor output or the controller output to the motor (pedal positions and motor torque). At the stop state, $T_e=0$ or $<T_{min}$ where $T_e$ is the motor output torque and $T_{min}$ is the minimum torque required to move the motor. At the stall or motor failure state, the condition is either $T_c\neq 0$ and the event set is $[T_e=0$ and $\Delta C_i=0]$ where $T_c$ is the controller output signal to the motor which may be positive or negative, $\Delta C_i$ represents an increment of pulse or the condition is $T_c\neq 0$ and the event set is $[\Delta C_i=0, i=1,2,3]$ where $C_i(i=1,2,3)$ is the pulse counting of each pedal. At the step over, sensor, or drive mechanism (including the drive screw) failure state, the condition is $T_c\neq 0$ and $T_e\neq 0$ and the condition set is either $[\Delta C_i=0, \Delta C_j\neq 0, (i\neq j)]$ or $|C_i-C_j|>C_{limit}(i\neq j, i,j,=1,2,3)]$ where $C_{limit}$ denotes a certain pulse limit, exceeding which a step over failure occurs. At the forward state, $T_e>0$. At the reverse state $T_e<0$. At the memory 1 state, $T_e=0$, $C_i=C_{mem1}$,(i=1,2,3) where $C_{mem1}$ is the first memorized pulse count. At the memory 2 state, $T_e=0$, $C_i=C_{mem2}$,(i=1,2,3) where $C_{mem2}$ is the second memorized pulse count. The switch signals are denoted as follows: F=1 indicates the forward switch is pushed or engaged; R=1 indicates the reverse switch is engaged or activated; M=1 indicates that the memory 1 switch is pushed or engaged; M=2 indicates that the memory 2 switch is pushed or engaged; L=1 indicates that the lock out switch is pushed or engaged; O=1 indicates that the override switch is pushed or engaged; I=1 indicates that the ignition key is on (this may also include or be replaced by D=1 which indicates the door is open); S=1 indicates save pulse count to memory; and FL=1 indicates the fault light or alarm is activated.

When the ignition key is on (I=1), the control pedals 12*a*, 12*b* automatically move to the previous memorized position and are ready to move. If the lock out feature is on (L=1), however, the control pedals 12*a*, 12*b* will remain in the present position and are unable to move until or unless the override switch 130 is engaged (O=1). Within the operation loop, there are three levels: a memory level wherein the control pedals 12*a*, 12*b* move to predefined positions stored in memory and stop; a moving level wherein the motor 58 will move the control pedals 12*a*, 12*b* forward and rearward depending of input signals from the switches 112; and a fault or failure level wherein the system has problems and the alarm 134 is activated. In the move level, the driver can adjust the control pedals 12*a*, 12*b* forward or rearward, by engaging the forward and rearward switches (F=1, R=1)120, 122 respectively, until the control pedals 12*a*, 12*b* reach a desired position. The position of the control pedals 12*a*, 12*b*, that is the pulse count, is saved in memory if the save switch 132 is activated (s=1) or some predetermined conditions are satisfied such as, for example, one of the memory switches 124, 126 are activated (M=1 or M=2) and no further movement occurs in a certain period of time. If a fault or failure is detected, the control pedals 12*a*, 12*b* are immediately stopped at the present position and the alarm 134 is activated (FL=1).

The electronic or "soft" stops can be implemented by establishing the number of pulses received from the sensor 114 over the desired stroke of the control pedals 12*a*, 12*b* (a total pulse count). Upper and lower pulse count limits ($C_{upper\text{-}limit}$ and $C_{lower\text{-}limit}$) are established where the control pedal 12*a*,12*b* can be stopped prior to engaging the mechanical or "hard" stops. For example, if the total pulse count is 130 where 130 is the far forward position and 0 is the far rearward position, the control pedal 12*a*, 12*b* can be operated between lower and upper pulse limits of about 5 and about 125 respectively.

FIGS. 9 to 12 illustrate a control pedal assembly 140 according to a second embodiment of the present invention. The control pedal assembly 140 is substantially similar to the control pedal assembly 10 of the first embodiment described hereinabove except as noted hereinbelow and like reference numbers are used for like structure. The illustrated first control pedal 12*a* is an brake pedal with mechanical brake control. The first adjustable control pedal 12*a* includes a support or upper arm 14, a support or lower arm 16 supported by the upper arm 14 and carrying a pad or pedal 40 for engagement by the foot of the motor vehicle operator, a link 142 pivotably connecting the lower arm 16, and a drive assembly 18 for moving the lower arm 16 relative to the upper arm 14 to adjust the position of the pedal 40.

The upper arm 14 is sized and shaped for pivotal attachment to a stationary support or mounting bracket 144. The mounting bracket 144 is adapted to rigidly attach the first control pedal 12*a* to a firewall or other rigid structure of the motor vehicle in a known manner. The upper arm 14 is adapted for pivotal attachment to the mounting bracket 144. The illustrated upper arm 14 has an opening 22 formed for cooperation with the mounting bracket 144 and an axle or pivot pin 146. With the pivot pin 146 extending through the mounting bracket 144 and the opening 22 of the upper arm 14, the upper arm 14 is pivotable relative to the fixed mounting bracket 144 about a horizontally and laterally extending pivot axis 26*a* formed by the central axis of the pivot pin 146.

The illustrated upper arm 14 is an elongate plate oriented in a vertical plane. The upper arm 14 is preferably formed of a suitable metal such as steel but can alternatively be formed of a suitable plastic such as NYLON. The upper pedal arm 14 is adapted for supporting the lower arm 16 and for selected fore and aft movement of the lower arm 16 as described in more detail hereinafter. The illustrated upper arm 14 has an elongate opening or slot 32 formed therein which generally extends in a forward/rearward direction along the length of the link lower portion 12*b*. The illustrated slot 32 is arcuate or curved and is rearwardly inclined, that is, the rearward end of the slot 32 is at a lower height than the forward end of the slot 32. The upper arm 14 is substantially planar or flat in the area of the slot 32 and the slot 32 is open laterally through the entire thickness of the upper arm 14. The slot 32 is sized and shaped for cooperation with the lower arm 16 for desired forward/rearward movement of the pedal 40 relative the upper arm 14 over a desired adjustment range, such as about three inches, as described in more detail hereinbelow.

The upper arm 14 is operatively connected to a control device such as a brake such that pivotal movement of the upper arm 14 about the pivot axis 26*a* operates the control device in a desired manner responsive to the position of the pedal 40. The upper arm 14 can be connected to the control device by, for example, a push-pull or Bowden cable for mechanical actuation or by a sensor and electrical wire or cable for electronic actuation. The illustrated upper arm 14 is provided with a pin 28 for connection to the control device by a mechanical actuator.

The lower arm 16 is preferably formed of a suitable metal such as steel but can alternatively be formed of a suitable plastic such as NYLON. The illustrated lower arm 16 is formed of an elongate plate oriented in a vertical plane substantially parallel to plane of the upper arm 14. The upper end of the lower arm 16 is adapted for movement relative to upper arm 14 along the slot 32. The upper end of the lower arm 16 is provided with a guide 42 in the form of a pin and a drive pin 148 laterally and horizontally extending therefrom to cooperate with the slot 32 and the link 142 to form sliding pin/slot and pivoting connections respectively for moving the lower arm 16 relative to the upper arm 14. A suitable guide 42 and a suitable drive pin 148 are described in U.S. Pat. No. 6,367,349, the disclosure of which is expressly incorporated herein in its entirety by reference. The lower end of the lower arm 16 is sized and shaped to carry the rearward-facing pedal 40. The pedal 40 is adapted for depression by the driver of the motor vehicle to pivot the control pedal 12*a* about the pivot axis 26*a* to obtain a desired control input to the motor vehicle through the movement of the pin 28.

The link 142 is preferably formed of a suitable metal such as steel but can alternatively be formed of a suitable plastic such as NYLON. The illustrated link 142 is formed of an elongate plate oriented in a vertical plane substantially parallel to plane of the upper and lower arms 14, 16. The illustrated link is pivotable about the pivot pin 146 and the pivot axis 26*a* The upper end of the link 142 is provided with an opening sized and shaped for pivotable attachment of the link 142 to the pivot pin 146. The lower end of the link 142 is provided with an opening sized and shaped to cooperate with the drive pin 148 as described hereinabove.

The drive assembly 18 includes a screw shaft or drive screw 50, a drive screw attachment or housing 52 for securing the drive screw 50 to the upper arm 14, a drive nut 54 adapted for movement along the drive screw 50 in response to rotation of the drive screw 50, an electric motor 58 for rotating the drive screw 50. The drive screw 50 is an elongate shaft having a threaded portion adapted for cooperation with the drive nut 54. The drive screw 50 is preferably formed of a metal such as, for example, steel but can be alternately formed of a plastic resin such as, for example, NYLON. The rearward and downward end of the drive screw 50 is journaled by the drive screw housing 52 for rotation of the drive screw 50 by the motor 58. The illustrated drive screw 50 forwardly and upwardly extends from the drive screw housing in a cantilevered fashion so that it extends forward of the upper arm 14. The drive screw 50 is preferably connected to the drive screw housing 52 with a self-aligning or freely pivoting joint, that is, a joint which freely permits pivoting of the drive screw 50 relative to the drive screw housing 52 and the upper arm 14 about at least axes perpendicular to the drive screw rotational axis 64. The self-aligning joint automatically corrects misalignment of the drive screw 50 and/or the drive nut 54. The self-aligning joint also allows nonlinear travel of the drive nut 54 upon pivoting of the link 142. The self aligning joint can be, for example, a ball/socket type joint. It is noted that alternatively the self aligning joint can be between the drive screw housing 52 and the upper arm 14.

The drive nut 54 is secured to the drive pin 148 and is adapted for axial movement along the drive screw 50 in response to rotation of the drive screw 50. The drive nut 54 is preferably molded of a suitable plastic material such as, for example, NYLON but can alternatively be formed of metal such as, for example steel. The drive pin 148 can be connected to the drive nut 54 with rigid connection or a self-aligning or freely pivoting joint, that is, a joint which freely permits pivoting of the drive nut 54 relative to the drive pin 148 about at least axes perpendicular to the rotational axis 64 of the drive screw 50. The self-aligning joint automatically corrects misalignment of the drive nut 54 and/or drive screw 50. The self aligning joint can be, for example, a ball/socket type joint.

The electric motor 58 can be of any suitable type and is secured to upper arm 14 so that the motor 58 is carried by the upper arm 14 and pivots with the upper arm 14 about the pivot axis 26*a*. The motor 58 is operably connected to the rearward or lower end of the drive screw 50 so that rotation of the motor 58 rotates the drive screw 50. The motor 58 is directly connected to the drive screw 50, that is, a rigid connection is provided without the use of flexible cables or the like. It is noted that suitable gearing is provided between the motor 58 and the drive screw 50 as necessary depending on the requirements of the control pedal 12*a*.

To adjust the position of the pedal 40 of the first control pedal 12*a*, the driver activates rotation of the motor 58 in the desired direction. Rotation of the motor 58 directly rotates the drive screw 50 and causes the drive nut 54 to axially move along the drive screw 50 in the desired direction. The drive nut 54 moves along the drive screw 50 because the drive nut 54 is held against rotation with the drive screw 50 by the drive pin 148. As the drive nut 54 axially moves along the drive screw 50, the drive pin 148 pivots the link 142 about its pivot axis 26*a* because the drive pin 148 is secured to the link 142. It is noted that binding of the drive nut 54 along the drive screw 50 is minimized if a self-aligning joint is provided to automatically align the components so that the drive nut 54 can smoothly travel along the drive screw 50. As the drive pin 148 pivots the link 142, the lower arm 16 is moved therewith to adjust the forward/rearward position of the pedal 40. As the lower arm 16 moves, the guide pin 42 slides along the slot 32. With such movement, the pedal 40 travels in a substantially linear and horizontal path, that is, the pedal 40 moves in a forward/rearward direction and generally remains at the same height relative to the fixed mounting bracket 144 and the upper arm 14 which does not move relative the mounting bracket 144 during adjustment of the pedal 40. It is noted that the pedal 40 rotates as the lower arm 16 moves so that the orientation of the pedal 40 slightly changes. As the position of the pedal 40 is adjusted by rotating the drive screw 50, the upper arm 14 remains in fixed position relative to the mounting bracket 144. It can be seen from the above description that activation of the motor 58 changes the position of the lower arm 16 relative to the upper arm 14 but not the position of the upper arm 14 relative to the mounting bracket 144 and therefore does not affect the connection of the upper arm 14 to the control device of the motor vehicle through the pin 28.

The illustrated second control pedal 12*b* is an accelerator pedal with electronic throttle control. The second control pedal 12*b* includes a stationary support or mounting bracket 150, a support or upper arm 14 supported by the mounting bracket, a support or lower arm 16 supported by the upper arm 14 and carrying a pedal 40 for engagement by the foot of the motor vehicle operator, and a drive assembly 18 for moving of the upper arm 14 relative to the mounting bracket 150 to adjust the position of the pedal 40.

The mounting bracket 150 is adapted to rigidly attach the second adjustable control pedal 12*b* to a firewall or other rigid structure of the motor vehicle in a known manner. The upper arm 14 is adapted for fore/aft movement relative to the mounting bracket 150. The illustrated mounting bracket 150 has the pair of vertically extending and laterally-spaced-apart walls 152. Each wall 152 has a guide slot 32 formed therein which generally extends in a forward/rearward direction. The illustrated slots 32 are each substantially straight and horizontal. The walls also each provide horizontal and laterally spaced-apart guide or bearing surfaces 154 formed by the top of the walls 152. The illustrated bearing surfaces 154 are located directly above the slots 32. The slots 32 and bearing surfaces 154 are sized and shaped for cooperation with the upper arm 14 for substantially linear forward/rearward movement of the pedal 40 relative the mounting bracket 150 over a desired adjustment range, such as about three inches, as described in more detail hereinbelow. The mounting bracket 150 is preferably formed of a suitable plastic such as NYLON but can alternatively be formed of any suitable material such as a suitable metal like steel.

The upper arm 14 is adapted for linear movement relative to mounting bracket 150 along the slots 32 and the bearing surfaces 154. The upper arm 14 is provided lower guides or supports 156 in the form of opposed pins which extend into the slots 32 of the mounting bracket 150 to form sliding pin and slot connections for linearly moving the upper arm 14 relative to the mounting bracket 150. A suitable lower guide 156 is described in U.S. Pat. No. 6,367,348, the disclosure of which is expressly incorporated herein in its entirety by reference. The upper arm 14 is also provided with upper guides or supports 158 in the form of opposed pins which engage the bearings surfaces 154 at the top of the mounting bracket 150. The upper arm 14 is preferably formed of a suitable plastic such as NYLON but can alternatively be formed of any suitable material such as a suitable metal like steel.

The upper end of the lower arm 16 is pivotably mounted to the upper arm 14 about a pivot 160. Mounted in this manner, the lower arm 16 is pivotable relative to the upper arm 14 about a horizontally and laterally extending pivot axis 26*b* formed by the central axis of the pivot 160. The lower arm 16 is preferably formed of a suitable plastic such as NYLON but can alternatively be formed of any suitable material such as a suitable metal like steel. The lower end of the lower arm 16 is sized and shaped to carry the rearward-facing pedal 40. The pedal 40 is preferably unitary with the lower arm 16 such as by molding but alternatively can be attached to the lower arm 16. The pedal 40 is adapted for depression by the driver of the motor vehicle to pivot the pedal 40 about the pivot axis 26*b* to obtain a desired control input to the motor vehicle.

The lower arm 16 is operatively connected to a control device such as a motor vehicle throttle such that pivotal movement of the lower arm 16 about the pivot axis 26*b* operates the control device in a desired manner corresponding to the position of the pedal 40. The illustrated lower arm 16 is connected to the control device by an electronic throttle control module ("ETC module") 162 for electronic actuation. The ETC module 162 senses pivotable movement and/or position of the lower arm 16 relative to the upper arm 14 and sends electronic signals regarding such via a electric cable or wire connected thereto. The electronic throttle control module 162 can be of any suitable type known in the art.

The drive assembly 18 includes a screw shaft or drive screw 50, a drive screw attachment or housing 52 for securing the drive screw 50 to the mounting bracket 150, a drive nut 54 adapted for movement along the drive screw 50 in response to rotation of the drive screw 50, an electric motor 58 for rotating the drive screw 50. The drive screw 50 is an elongate shaft having a threaded portion adapted for cooperation with the drive nut 54. The drive screw 50 is preferably formed of a metal such as, for example, steel but can be alternately formed of a plastic resin such as, for example, NYLON. The rearward end of the drive screw 50 is journaled by the drive screw housing 52 for rotation of the drive screw 50 by the motor 58. The illustrated drive screw 50 forwardly extends from the drive screw housing in a cantilevered fashion between the walls 152 of the mounting bracket 150.

The drive nut 54 is secured to the upper arm 14 and is adapted for axial movement along the drive screw 50 in response to rotation of the drive screw 50. The drive nut 54 is preferably molded of a suitable plastic material such as, for example, NYLON but can alternatively be formed of metal such as, for example steel.

The electric motor 58 can be of any suitable type and is secured to mounting bracket 14 so that the motor 58 is carried supported by the mounting bracket 150. The motor 58 is operably connected to the rearward end of the drive screw 50 so that rotation of the motor 58 rotates the drive screw 50. The motor 58 is directly connected to the drive screw 50, that is, a rigid connection is provided without the use of flexible cables or the like. It is noted that suitable gearing is provided between the motor 58 and the drive screw 50 as necessary depending on the requirements of the control pedal 12*a*.

To adjust the second control pedal 12*b*, the driver activates rotation of the motor 58 in the desired direction. Rotation of the motor 58 rotates the drive screw 50 and causes the drive nut 54 to axially move along the drive screw 50 in the desired direction. The drive nut 54 moves along the drive screw 50 because the drive nut 54 is held against rotation with the drive screw 50 by the upper arm 14. As the drive nut 54 axially moves along the drive screw 50, the lower guides 156 move along the slots 32 and the upper guides 158 move along the bearing surfaces 154 formed by the top of the mounting bracket 150. As the guides 156, 158 slidingly move along the slots 32 and bearing surfaces 154 respectively, the upper arm 14 is moved and the lower pedal arm 16 is carried therewith. With such movement, the pedal 40 travels in a substantially linear and horizontal path, that is, the pedal 40 moves in a forward/rearward direction and generally remains at the same height relative to the fixed mounting bracket 150 during adjustment of the pedal 40. Additionally, the pedal 40 is not rotated as the upper arm 14 moves so that the orientation of the pedal does not substantially change. It can be seen from the above description that activation of the motor 58 changes the position of the upper and lower arms 14, 16 relative to the mounting bracket 150 but not the position of the upper arm 14 relative to the lower arm 16 and therefore does not affect the rotational sensing of the ETC module 162.

Figure 13:
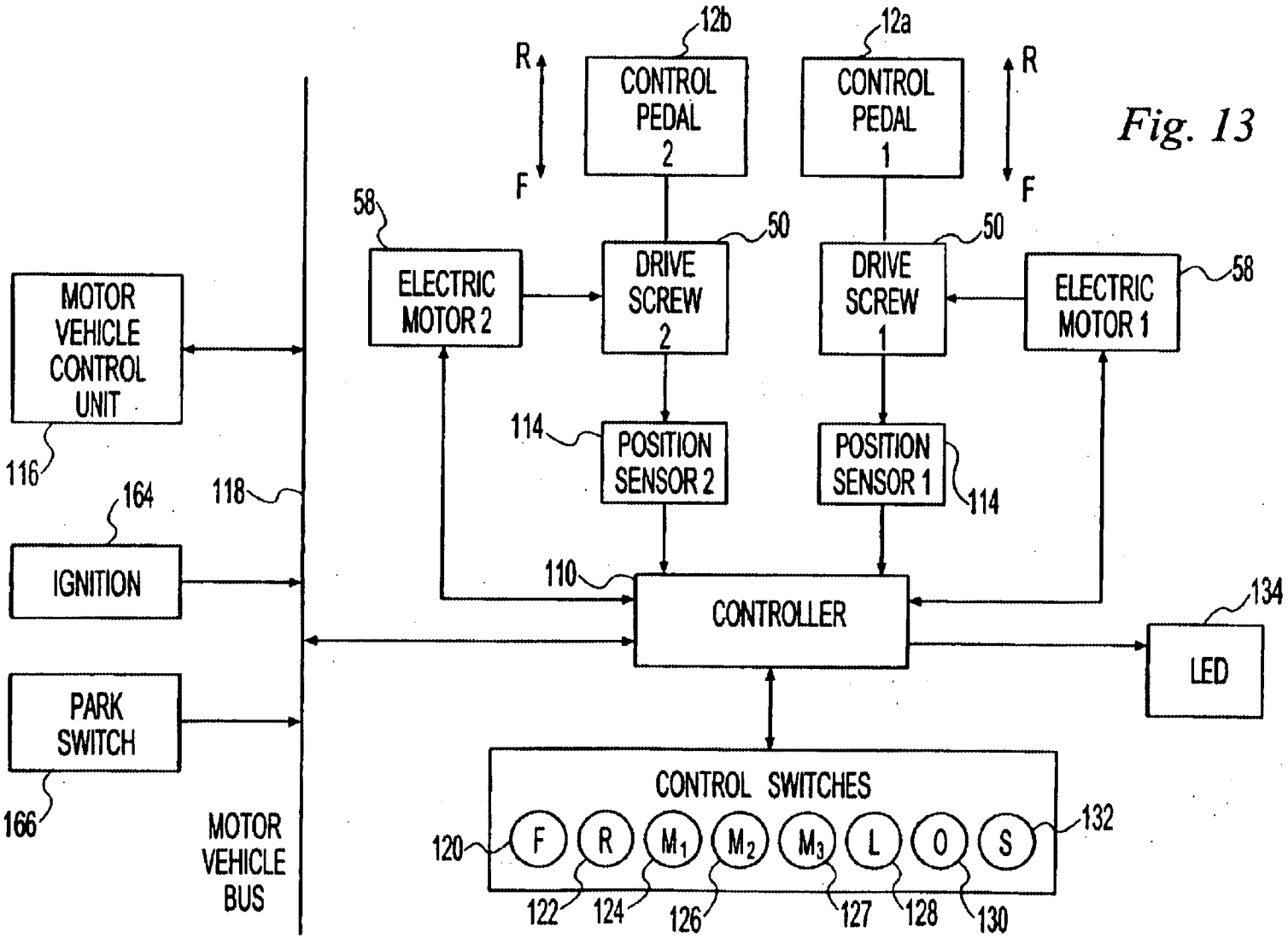
FIG. 13 is a schematic view of a control system for the adjustable control pedal assembly of FIGS. 9 to 12.

As best shown in FIG. 13, the control system 13 preferably includes a central processing unit (CPU) or controller 110 for activating the motors 58, control switches 112 for inputting information from the driver to the controller 110, and switches or sensors 114 for detecting motion of the control pedals 12*a*, 12*b* such as by directly sensing rotation of the drive screws 50. The control system 13 forms a control loop wherein the controller 110 selectively sends signals to the motors 58 to activate and deactivate the motors 58. When activated, the motors 58 directly rotate the drive screws 50. The sensors 114 detect movement of the control pedals 12*a*, 12*b*, such as by directly detecting rotations of the drive screws 50, and send signals to the controller 110.

The sensors 114 are adapted to detect movement of the control pedal assembly 10 and send signals relating to such movement to the controller 110. The illustrated sensors 114 are located adjacent the drive screws 50 and adapted to detect rotations of the drive screws 50. It is noted, however, that other sensors for detecting motion would be readily apparent to those skilled in the art such as, for example, sensors for detecting rotational or other movement between upper and lower arms. The sensors 114 are preferably linear potentiometers mounted adjacent the drive screws 50 to directly sense each rotation of the drive screw 50 and to send pulses or signals to the controller 110 for each revolution of the drive screws. Note, however, that the pulses or signals can alternatively be for a portion of a rotation or for more than one rotation. The sensors 114 can alternately be another suitable non-contact sensor such as, for example, an inductance sensor, a Hall-effect device, an encoder, or the like or a suitable contact sensor or switch, or other suitable means for determining motion and/or rotary motion. The switches or sensors 114 can also be located at other locations such as, for example, directly at an interface between the upper and lower arms 14, 16, directly at an interface between the mounting bracket 150 and the upper arm 14, and/or at the drive shaft or other component of the motors 58. The switches and sensors 114 can also be eliminated if the controller utilizes information directly received from the motors 58.

The rotational information obtained by sensors 114 is utilized by the controller 110 to control the control pedals 12*a*, 12*b* as discussed hereinabove with regard to the first embodiment. Of particular significance is "step-over" protection, that is, maintaining the predetermined fore-aft relationship between the two pedals 40 of the first and second control pedals 12*a*, 12*b*. Preferably, the pedals 40 have a predetermined fore-aft relationship, that is, a desired distance between the pedals 40 in the forward-rearward direction. When the position of the pedals 40 is adjusted, the pedals 40 are preferably moved simultaneously in unison so that the predetermined fore-aft relationship is maintained. By receiving movement and/or location information regarding each of the first and second control pedals 12*a*, 12*b*, the controller 110 can identify when the control pedals 12*a*, 12*b*, are not moving in the same manner and the predetermined fore aft relationship has not been maintained. When the controller 110 determines that the predetermined fore-aft relationship has not been maintained, the controller 110 preferably automatically adjusts movement of the motors 58 to automatically reestablish the predetermined fore-aft relationship. Alternatively, the controller stops the motors 58 and provides a warning that the system has failed when the predetermined relationship between the two control pedals 12*a*, 12*b* has not been maintained. If the controller 110 cannot reestablish the predetermined fore-aft relationship than the controller 110 stops the motors 58 and provides a warning that the system has failed when the predetermined relationship between the two control pedals 12*a*, 12*b* has not been maintained.

Figure 14:
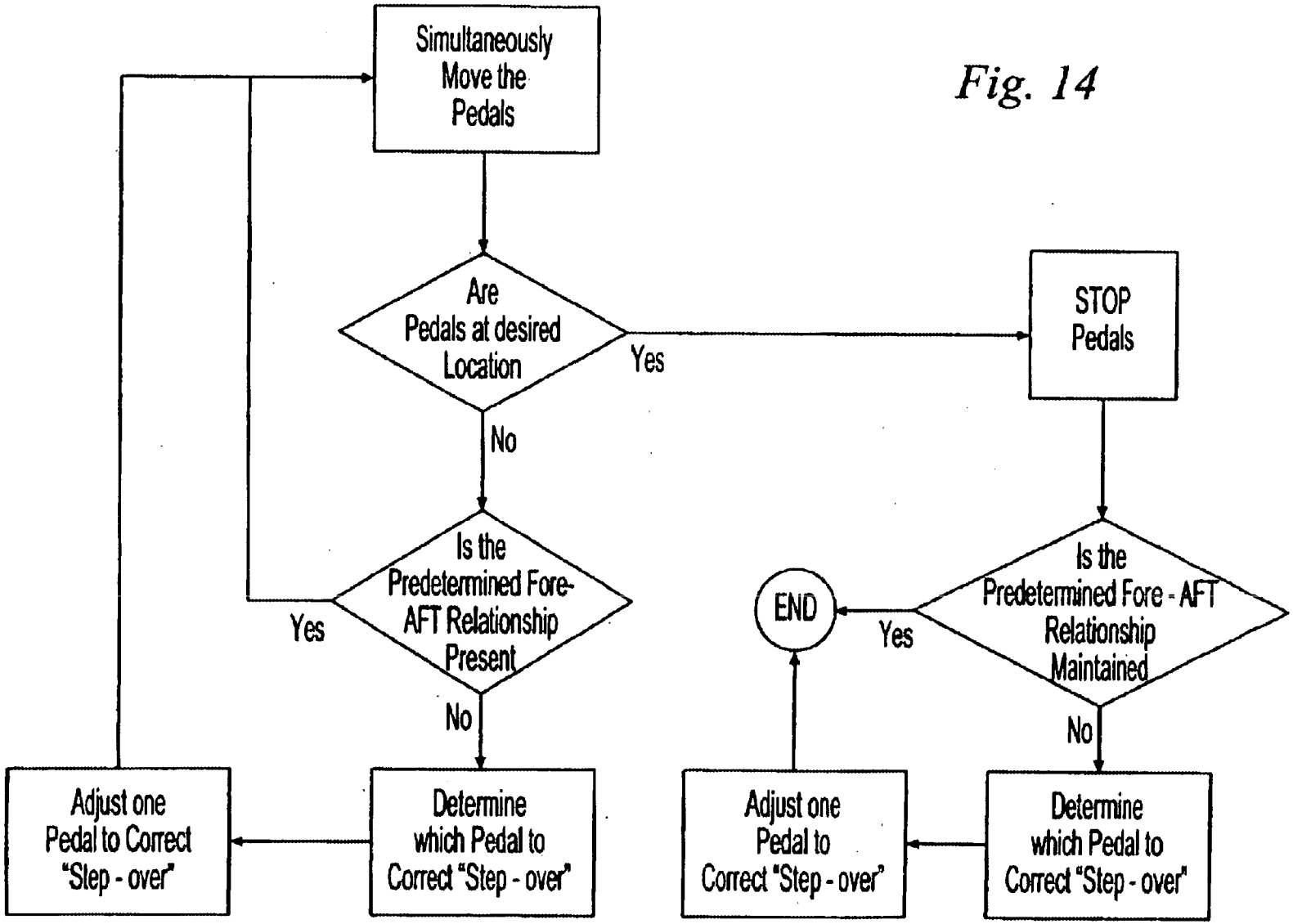
FIG. 14 is a flow chart showing "step-over" protection for the adjustable control pedal assembly of FIGS. 9 to 13.

As best shown in FIG. 14, the controller can reestablish the predetermined relationship during movement of the control pedals and/or after the control pedals 12*a*, 12*b* have been moved to a desired location. The controller 110 preferably reestablishes the predetermined fore-aft relationship during movement by temporarily increasing the speed of the motor 58 of the trailing control pedal 12*a*, 12*b* relative to the speed of the leading control pedal 12*a*, 12*b* until the predetermined fore-aft relationship is reestablished. It is noted, however, that there are many variations and alternative methods of reestablishing the predetermined relationship. Alternatively, the controller 110 can temporarily increase or decrease the speed of the leading control pedal 12*a*, 12*b* relative to the trailing control pedal 12*a*, 12*b* until the predetermined fore-aft relationship is reestablished. Alternatively, the controller 110 can temporarily increase or decrease the speed of the trailing control pedal 12*a*, 12*b* relative to the leading control pedal 12*a*, 12*b* until the predetermined fore-aft relationship is reestablished. Alternatively, the controller 110 can temporarily stop movement of either the leading control pedal 12*a*, 12*b* or the trailing control pedal 12*a*, 12*b* until the predetermined fore-aft relationship is reestablished. Alternatively, the controller 110 can in combination both temporarily increase or decrease the speed of the leading control pedal 12*a*, 12*b* and temporarily increase or decrease the speed of the trailing control pedal 12*a*, 12*b* until the predetermined fore-aft relationship is reestablished. Of course any suitable combination of these alternatives can be utilized. These alternatives are preferably performed automatically as soon as the controller 110 determines that the predetermined fore-aft relation ship has not been maintained. Alternatively, the controller 110 can wait until one of the control pedals 12*a*, 12*b* has reached its desired location and then temporarily move the other one of the control pedals 12*a*, 12*b* as needed until the predetermined fore-aft relationship is reestablished. It is noted that the fore-aft relationship between the control pedals 12*a*, 12*b* is preferably only corrected if it is not within a tolerance range such as, for example, if the actual distance is more or less than 5 mm from a predetermined distance.

The controller 110 can be adapted to make adjustments to both of the control pedals 12*a*, 12*b* or only one of the control pedals 12*a*, 12*b*. When making adjustments to only one of the control pedals 12*a*, 12*b*, the other control pedal 12*a*, 12*b* runs freely without adjustment. This can reduce cost and complexity of the controller 110. For example, the controller 110 can receive information directly from the motors 58, such as a voltage information in the form of a square wave, from which the controller can determine position and speed of the pedals 40. The speed of one of the pedals 40 can be adjusted by pulse width modulation to match the other pedal 40 or make adjustments relative to the other pedal 40. Preferably, the controller 110 controls the speed by pulse width modulation. The controller 110 can receive only position information from the motors 58, such as voltage, or can also receive motor current information from the motors 58. The motor current information can also be useful in indicating that the pedals 40 have engaged an obstruction. It is noted that by utilizing information directly received from the motors 58 to maintain the predetermined fore-aft relationship between the pedals, the switches or sensors 114 can be eliminated unless they are desired for another function such as failure detection.

FIG. 15 illustrates the input signals utilized by the controller 110 and the output signals provided by the controller 110 for the various operations or processes of the adjustable control pedal assembly 140 of the preferred embodiment. For "auto-egress", the controller 110 utilizes signals from the ignition 164, park switch 166, and position sensors 114 to operate the motors 58 to automatically move the pedals 40 to a desired position, such as full forward, when the ignition 164 is off and/or the park switch 166 is on. For "soft stops", the controller 110 utilizes signals from the position sensors 114 to automatically stop the motors 58 prior to engaging physical ends of travel. For "step-over protection", the controller 110 utilizes signals from the position sensors 114 to automatically operate the motors 58 to maintain a desired fore-aft relationship between the pedals 40. For "anti-theft" protection, the controller 110 utilizes signals from the ignition 164, the park switch 166, the position sensors 114, and the motors 58, to automatically operate the motors 58 to move the pedals 40 to a desired position, such as full forward or full rearward, when the ignition 164 and/or park switch 166 indicates that the vehicle is being stolen. For motor speed control, the controller 110 utilizes signals from the position sensors 114 to adjust the speed of the motors 58 and thus the pedals 40 as desired. For obstacle detection, the controller 110 utilizes signals from the position sensors 114 and the motors 58 to stop or reverse the motors 58 when the motor current indicates that the pedals 40 may have contacted an obstruction. For fault detection, the controller 110 utilizes signals from the position sensors 114 and the motors 58 to illuminate the LED light 134 when there has been a failure, such as a motor 58 failure of a step-over protection failure. For manual pedal forward or reverse, the controller 110 utilizes signals from the ignition 164, park switch 166 and forward and reverse buttons 120, 122 to operate the motors 58 in the desired direction when the ignition switch 164 is off, the park switch 166 is on and the forward or reverse button 120, 122 is depressed. For memory position set, the controller 110 utilizes signals from the ignition 164, the position sensors 114, and the memory buttons 124, 126, 127, to provide instructions via the LED light 134 and store the current position in memory when a memory button 124, 126, 127 is depressed for a predetermined period of time and the ignition 164 is off. For memory position recall, the controller 110 utilizes signals from the ignition 164, the park switch 166, the position sensors 114, and the memory buttons 124, 126, 127 to operate the motors 58 to move the pedals 40 to the stored position when a memory button 124, 126, 127 is depressed while the ignition 164 is off and the park switch 166 is on.

It is noted that each of the features of the various disclosed embodiments can be used with each of the other disclosed embodiments.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the control pedal assembly can at least partly be operated from a remote control unit such as a keyless entry device. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A control pedal assembly comprising, in combination:

a first control pedal including a first pedal adjustable in a fore-aft direction upon operation of a first motor;

a second control pedal including a second pedal adjustable in a fore-aft direction upon operation of a second motor;

wherein the first pedal and the second pedal have a predetermined fore-aft relationship;

a controller operably connected to the first motor and the second motor; and wherein the controller is programmed to operate the first and second motors to simultaneously move the first and second pedals in the fore-aft direction and to reestablish the predetermined relationship if the predetermined fore-aft relationship is not maintained as a result of the movement of the first and second control pedals.

2. The control pedal assembly according to claim 1, wherein the first motor is not connected to the second control pedal to move the second pedal and the second motor is not connected to the first control pedal to move the first pedal.

3. The control pedal assembly according to claim 1, wherein the first control pedal includes a first sensor sensing movement of the first pedal, the second control pedal includes a second sensor sensing movement of the second pedal, and wherein the controller is in communication with the first and second sensors to receive signals from the first and second sensors indicating movement of the first and second pedals respectively.

4. The control pedal assembly according to claim 3, wherein the first and second sensors are each selected from the group of a Hall effect device, an inductance sensor, a potentiometer, and an encoder.

5. The control pedal assembly according to claim 3, wherein the controller is programmed to determine a position of the first pedal based on the signals from the first sensor and to determine a position of the second pedal based on the signals from the second sensor.

6. The control pedal assembly according to claim 3, wherein the controller is in communication with the first and second motors to receive signals from the first and second motors indicating movement of the first and second pedals respectively.

7. The control pedal assembly according to claim 6, wherein the controller is programmed to determine a position of the first pedal based on the signals from the first motor and to determine a position of the second pedal based on the signals from the second motor.

8. The control pedal assembly according to claim 1, wherein the first control pedal includes means for indicating movement of the first pedal, the second control pedal includes means for indicating movement of the second pedal, and wherein the controller is in communication with each of the means for indicating movement of the first pedal and the means for indicating movement of the second pedal to receive signals from the means for indicating movement of the first pedal and the means for indicating movement of the second pedal which indicate movement of the first and second pedals respectively.

9. The control pedal assembly according to claim 8, wherein the controller is programmed to determine a position of the first pedal based on the signals from the means for indicating movement of the first pedal and to determine a position of the second pedal based on the signals from the means for indicating movement of the second pedal.

10. A method of operating a control pedal assembly comprising the steps of, in combination:

providing a first adjustable control pedal including a first pedal adjustable in a fore-aft direction upon operation of a first motor;

providing a second adjustable control pedal including a second pedal adjustable in a fore-aft direction upon operation of a second motor;

providing a predetermined fore-aft relationship between the first pedal and the second pedal;

simultaneously moving the first and second pedals in the fore aft direction; and reestablishing the predetermined fore-aft relationship if the predetermined fore-aft relationship is not maintained as a result of the step of simultaneously moving the first and second control pedals in the fore-aft direction.

11. The method according to claim 10, further comprising the step of sensing movement of the first and second pedals with sensors.

12. The method according to claim 11, further comprising the step of determining movement of the first and second pedals using information from the sensors.

13. The method according to claim 10, further comprising the step of determining movement of the first and second pedals using information from the first and second motors.

14. The method according to claim 13, wherein the step of determining movement of the first and second pedals using information from the first and second motors includes using motor voltage of each of the first and second motors.

15. The method according to claim 10, further comprising the step of identifying when the predetermined fore-aft relationship is not maintained.

16. The method according to claim 10, wherein the step of reestablishing the predetermined fore-aft relationship includes adjusting only one of the first and second pedals.

17. The method according to claim 10, wherein the step of reestablishing the predetermined fore-aft relationship includes adjusting both of the first and second pedals.

18. The method according to claim 10, wherein the step of reestablishing the predetermined fore-aft relationship includes adjusting speed of at least one of the first and second pedals.

19. The method according to claim 10, wherein the step of reestablishing the predetermined fore-aft relationship occurs during the step of simultaneously moving the first and second pedals.

20. The method according to claim 10, wherein the step of reestablishing the predetermined fore-aft relationship occurs after the step of simultaneously moving the first and second pedals.

* * * * *